US006137046A

United States Patent [19]

Kamiya

[11] Patent Number: 6,137,046

[45] Date of Patent: Oct. 24, 2000

[54] TONE GENERATOR DEVICE USING WAVEFORM DATA MEMORY PROVIDED SEPARATELY THEREFROM

[75] Inventor: Ryo Kamiya, Hamamatsu, Japan

[73] Assignee: Yamaha Corporation, Shizuoka, Japan

[21] Appl. No.: 09/121,083

[22] Filed: Jul. 23, 1998

[30] Foreign Application Priority Data

Jul. 25, 1997 [JP] Japan ..... 9-200662
Aug. 8, 1997 [JP] Japan ..... 9-214853

[51] Int. Cl.[7] ..... G10H 7/00

[52] U.S. Cl. ..... 84/604; 84/601; 84/603

[58] Field of Search ..... 84/601–607, 627

[56] References Cited

U.S. PATENT DOCUMENTS 4,715,257 12/1987 Hoshiai et al. ..... 84/1.01
5,763,801 6/1998 Gulick ..... 84/604
5,892,170 4/1999 Ichiki et al. ..... 84/605
5,902,948 5/1999 Haruyama ..... 84/609

*Primary Examiner*—Paul Ip
*Assistant Examiner*—Marlon Fletcher
*Attorney, Agent, or Firm*—Morrison & Foerster, LLP

[57] ABSTRACT

Tone generator device, which is applied to a computer, has no waveform memory of its own and is connected via an extended bus to the computer having a main memory where waveform sample data are prestored. When a tone of predetermined pitch is to be reproduced, the tone generator device designates a block of a specific quantity of the waveform sample data in accordance with the pitch to be reproduced and requests that the block be read out from the main memory and burst-transmitted via the extended bus. The burst-transmitted waveform sample data are temporarily stored in an input buffer and then read out from the buffer in accordance with pitch information to generate tone waveform data of the desired pitch. The burst transmission of the data block and subsequent tone waveform data generation are carried out at high speed asynchronously with a predetermined reproduction sampling cycle. The generated tone waveform data are output via an output data in the predetermined reproduction sampling cycle. To raise the upper limit on the reproducible pitch without a need to increase the capacity of the input buffer, a thinned version of the original waveform sample data may also be prestored in the main memory so that the thinned waveform sample data can be selected to permit the raised upper limit. Alternatively, such thinned waveform sample data may be generated by thinning the original waveform sample data, rather than being prestored in the main memory.

48 Claims, 16 Drawing Sheets

TONE GENERATOR DEVICE USING WAVEFORM DATA MEMORY PROVIDED SEPARATELY THEREFROM

BACKGROUND OF THE INVENTION

The present invention relates to a tone generator device which is suitable for connection to a computer system to generate tones using waveform data supplied from the computer system.

The present invention also relates to a tone data processing device and computer system which are suitable for use in tone data generation based on waveform data and pitch information.

In recent years, many personal computers are equipped with a hardware-based tone generator device, which is typically in the form of a tone generator board including a tone generator LSI of predetermined design, to permit various sorts of sound generation processing. According to a typical example of a tone generating principle employed in such a tone generator device, original waveform data are read out from a waveform memory (or a waveform table or wave table) at a rate corresponding to a pitch of each tone to be generated. In this case, the original waveform data stored in the wave table are the results of sampling a tone signal obtained through actual performance of a musical instrument at a predetermined pitch, and a tone data reproduction process is carried out on the basis of tone control data designating a particular pitch, volume, etc. as well as the waveform data stored in the wave table.

Today, tone generator devices connectable to an ISA (Industry Standard Architecture) bus are widely used, as examples of such a hardware-based tone generator device for use with a computer system. The tone generator devices connectable to the ISA bus may be mounted in a variety of ways; for example, they may be mounted on an extension card having a connector attachable into a slot in the ISA bus, or on a system board (mother board) of the computer system. In this type of tone generator device so far proposed, the waveform memory prestoring original waveform data is provided within the tone generator device.

FIG. 16 is a block diagram illustrating a hardware setup of a conventional tone generator device employing the waveform-memory-based tone generating scheme. The illustrated tone generator device is capable of simultaneously generating up to three tones; that is, the maximum number of simultaneously generatable tones in the tone generator device is three. Waveform memory M has prestored therein a plurality of sets of waveform data—in the figure, there are shown only three waveform data sets W1 to W3. Each of the waveform data sets basically comprises waveform sample data for each individual sampling cycle and includes, at its start or head address, data indicative of an original sampling frequency (which will also be called an "input sampling frequency"). The waveform memory M comprises a ROM (Read Only Memory) or RAM (Random Access Memory) and is connected to an internal bus of the tone generator device.

The tone generator device of FIG. 16 further includes an ISA bus interface IF connectable to an ISA bus of a computer system, and address calculating sections A1 to A3 each of which calculates an address to read out a particular sample of the corresponding waveform data W1–W3 from the memory M and then actually reads out the sample of the waveform data W1–W3 from the calculated address. The tone generator device also includes an adder ADD for adding together the waveform sample data output from the address calculating sections A1 to A3, and a D/A converter (DAC) for converting the added result from the adder ADD into an analog signal and then outputting the analog signal to an external device such as a sound system including an amplifier and speaker.

In the tone generator device, a control unit C, in response to an instruction received via the ISA bus IF, supplies the respective head addresses of the waveform data sets (three sets W1 to W3 in the illustrated example) to the corresponding address calculating sections A1 to A3, sets a sampling frequency of the waveform data to be output from each of the address calculating sections A1 to A3 (hereinafter called an "output sampling frequency"), and instructs each of the calculating sections A1 to A3 to start reading out the waveform data.

In response to the readout start instruction given from the control unit C, each of the address calculating sections A1 to A3 reads out the data, indicative of the input sampling frequency, from the head address of the corresponding waveform data set, and then sequentially reads out the waveform sample data, at intervals corresponding to the output sampling frequency, from the succeeding addresses calculated thereby on the basis of the head address and input and output sampling frequencies. If the output sampling frequency is different from the input sampling frequency, most addresses will not actually coincide with predetermined output timing; thus, in such a case, each of the address calculating sections A1 to A3 reads out the waveform sample data from an actually existent address preceding each virtual or imaginary address (containing a decimal portion) that is assumed to be coincident with the predetermined output timing, and generates waveform sample data for that address through interpolation using these data.

The reason why the memory M is provided within the tone generator device and connected to its internal bus instead of a main memory of the computer system being used by the tone generator device is that the data transfer rate of the ISA bus is far lower than the rate normally required for the tone generating processing.

The ISA bus, which has a 16-bit width and operates on an clock pulse frequency (bus clock frequency) of 8.33 MHz, provides a theoretical maximum data transfer rate of 8.33 MB (megabyte)/sec. However, because various items of equipment are usually connected to the ISA bus to share the same bus, they tend to frequently struggle for the bus, which would make an actual data transfer rate of the ISA bus far lower than the above-mentioned theoretical maximum data transfer rate.

Besides, in a situation where the output sampling frequency is different from the input sampling frequency, the address calculating sections A1 to A3, for the interpolation purposes, each read out two waveform sample data at separate timing from two addresses before and after a virtual address coincident with the predetermined output timing, as noted earlier. Because each waveform sample data is generally output in a one-to-one relation to a designated address, outputting two waveform sample data would require an operational sequence of designating a first address, then outputting first waveform sample data from the designated first address, then designating a second address, and then outputting second waveform sample data from the designated second address. Consequently, the quantity of data to be transferred in this case is twice as great as in the case where the output sampling frequency is equal to the input sampling frequency.

For the above-stated reasons, with those conventional tone generator devices expected to simultaneously generating over dozens of tones, it was very difficult to transfer the necessary quantity of the waveform data by way of the ISA bus, and thus there was an absolute need to provide a dedicated waveform memory in the tone generator device. However, because such a waveform memory is an expensive component part, every effort should be made to avoid the provision of the dedicated waveform memory if a reduced cost of the tone generator device is desired.

SUMMARY OF THE INVENTION

It is therefore an object of the present invention to provide a tone generator device which is capable of generating tones of sufficiently high quality without a dedicated waveform memory mounted on a tone generator board.

It is another object of the present invention to provide a tone waveform data processing device which permits expansion of a reproducible frequency range in a tone reproduction process while permitting a reduction in a necessary storage capacity of an input buffer that is used for storing waveform data from an external source.

To accomplish the above-mentioned object, the tone generator device according to the present invention does not include, on its tone generator board, a memory for storing waveform sample data; instead, such waveform sample data are prestored in a storage device separately provided from the tone generator device, and the tone generator device is arranged to receive necessary waveform sample data that are burst-transmitted from the storage device within a predetermined reproducing time frame. Namely, the present invention provides a tone generator device for generating tone waveform data on the basis of waveform sample data stored in a storage device provided separately from the tone generator device, which comprises: an input section that receives a block containing a specific quantity of the waveform sample data collectively transferred from the storage device; a temporary storage section that temporarily stores therein the waveform sample data collectively transferred from the storage device and received by the input section; and a tone waveform data generating section that reads out the waveform sample data from the temporary storage section in accordance with pitch information and generates tone waveform data corresponding to the pitch information on the basis of the waveform sample data read out from the temporary storage section.

The temporary storage section provided in the tone generator device may be a buffer memory capable of only temporarily storing some of the waveform sample data that are necessary for a single reproducing time frame. A complete set of the waveform sample data necessary for entire duration (i.e., start to end) of a generated tone are prestored in the storage device separately provided from the tone generator device. Thus, it is only necessary for the tone generator device to have a simple, small-capacity buffer memory, rather than a large-capacity memory storing the waveform sample data. Consequently, the memory arrangement in the tone generator device (on the tone generator board) can be considerably simplified and can be inexpensive as well. Because this type of tone generator device is used in a computer, it can make efficient use of the computer's main memory.

According to another aspect of the present invention, there is provided a tone generator device connectable to an extended bus of a computer. The computer includes a storage device connected to the extended bus, and the storage device has prestored therein waveform sample data. The tone generator device comprises: a control unit that designates a block containing a specific quantity of the waveform sample data and requests that the designated block of the waveform sample data should be read out from the storage device and burst-transmitted to the tone generator device via the extended bus; a temporary storage section that temporarily stores therein the waveform sample data burst-transmitted via the extended bus; and a tone waveform data generating section that reads out the waveform sample data from the temporary storage section in accordance with pitch information and generates tone waveform data corresponding to the pitch information on the basis of the waveform sample data read out from the temporary storage section. The burst transmission of the data block is carried out at high speed asynchronously with their predetermined reproduction sampling cycles. The burst-transmitted waveform sample data are temporarily stored into the storage section (i.e., buffer) and then read out from the storage section at a rate corresponding to the pitch information; in other words, the waveform sample data at only some of the sample points which are necessary for achieving a desired tone pitch are extracted and used to generate tone waveform data corresponding to the pitch information. Such a tone waveform data generating process may also be carried out at high speed asynchronously with the predetermined reproduction sampling cycles. Each of the thus-generated tone waveform data is then output through an output buffer at a predetermined reproduction sampling frequency. A unit length of time, within which a predetermined number of the reproduced tone waveform sample data are output at the reproduction sampling frequency, will hereinafter be called a "frame", and each of the burst-transmitted block is assumed here to comprise a predetermined quantity of the waveform sample data necessary for tone reproduction in a single frame. By burst-transmitting one block of the waveform sample data, necessary for tone reproduction in a next frame, at a suitable point within a given frame, the tone generation can be duly carried out in the next frame. In this way, the tone waveform sample data can be reproduced successively over a plurality of the frames by properly executing the block-by-block burst transmission of the waveform sample data every frame. This way, while permitting simplification and reduced cost of the memory arrangement in the tone generator device (on the tone generator board), the present invention can reproduce high-quality tones by just prestoring good-quality waveform sample data in the computer's storage device and allowing the tone generator device to make use of the prestored sample data.

Where the predetermined reproduction sampling frequency (DAC rate) is 48 kHz and the predetermined number of the reproduced tone waveform sample data output within one frame is 256, the time length of the frame amounts to about 5.3 msec. In generating tone waveform data for one frame (256 samples), from the storage section (input buffer) temporarily storing one burst-transmitted block of the waveform sample data, in accordance with the pitch information, the sample data readout from the storage section (input buffer) would involve necessary data thinning or duplication. Namely, when the waveform sample data are to be reproduced at the original pitch, these sample data are read out from the storage section (input buffer) with no data thinning or duplication. When the waveform sample data are to be reproduced at a pitch higher than the original (i.e., upward pitch shift or pitch-up), these sample data are read out from the storage section with suitable data thinning. In contrast, when the waveform sample data are to be reproduced at a pitch lower than the original (i.e., downward pitch shift or pitch-down), these sample data are read out from the storage section with suitable data duplication. For example, when a pitch three octave higher than the original pitch is to be reproduced and 256 sample outputs are to be obtained, it is necessary to buffer 2,048 (=256×8) original waveform sample data in the temporary storage section (input buffer). Stated otherwise, if the temporary storage section (input buffer) has a storage capacity of 2 KB (kilobyte) capable of storing up to 2,048 samples, then the maximum pitch-up amount will be three octaves higher than the original pitch, so that no higher pitch-up is not permitted in this case. To permit the higher pitch-up, it is only necessary to increase the storage capacity of the temporary storage section (input buffer). However, increasing the storage capacity of the temporary storage section (input buffer) would undesirably lead to an increase in the cost of the tone generator device (tone generator board).

According to still another aspect, the present invention permits a higher pitch-up without a need to increase the capacity of the temporary storage section (input buffer) in the tone generator device (on the tone generator board). One approach for achieving that goal is to prestore, in the computer's storage device (external to the tone generator device), predetermined original waveform sample data but also thinned waveform sample data created by thinning the original waveform sample data. A plurality of sorts, rather than one sort, of the thinned waveform sample data may be stored. In accordance with pitch information, the tone generator device selects the original waveform sample data or the thinned waveform sample data and determines the specific quantity of the selected waveform sample data to be received in one block. Thus, the block containing the specific quantity of the selected waveform sample data is read out from the storage device and burst-transmitted from the storage device, via the extended bus, to the tone generator device. This way, if the thinned waveform sample data, obtained by thinning the original waveform sample data to be two octaves higher than the original pitch, are burst-transmitted into the temporary storage section (input buffer) having a capacity of 2 KB (capable of storing up to 2,048 samples) and then read out at a rate eight times as fast as the original pitch, i.e., at a pitch three octaves higher than the original, a tone can be reproduced which has a pitch six (2×3) octaves higher than the original pitch.

Another approach is to prestore, in the computer's storage device (external to the tone generator device), predetermined original waveform sample data alone (i.e., with no thinned waveform sample data). To this end, the tone generator device further comprises a thinning section that, in accordance with pitch information, thins the original waveform sample data collectively transferred from the computer's storage device to thereby generate thinned waveform sample data. The thinned waveform sample data thus generated by the thinning section are temporarily stored into the storage section (input buffer). With this arrangement too, the present invention affords a higher pitch-up capability without increasing the capacity of the temporary storage section (input buffer).

Embodiments of the present invention, which will be hereinafter described with reference to the accompanying drawings are only for illustrative purposes, and the present invention should not construed as being limited to the described embodiments. For example, the term "computer" as used herein should be construed as referring to all devices and apparatuses having computer functions in the broad sense of the term, including not only stand-alone computer systems, such as personal computers and office computers, but also various other control devices comprising a CPU, ROM, RAM and the like incorporated in application equipment. Namely, the tone generator device (tone generator board) may of course be applied to provide personal computers with a sound generation processing function but also may be applied to provide such a sound generation processing function to various other control devices comprising a CPU, ROM, RAM and the like incorporated in application equipment (e.g., game machines and electronic controls in automotive vehicles).

The tone generator device and tone waveform data processing device of the present invention are basically implemented in the form of a hardware tone generator board, which may comprise dedicated discrete circuitry but also LSI circuitry. Such LSI circuitry may comprise a DSP (Digital Signal Processor), in which case the present invention can be embodied as a recording media for storing microprograms to be run by the DSP. Further, the tone generator board may itself contain a CPU, memory and the like of suitable size, in which case the present invention can be embodied as a recording media for storing a program to be run by the CPU. Moreover, the present invention can be embodied as a method of generating tone waveform data by reading out waveform sample data from a memory.

BRIEF DESCRIPTION OF THE DRAWINGS

For better understanding of various features of the present invention, preferred embodiments of the invention will hereinafter be described in greater detail with reference to the accompanying drawings, in which.

DETAILED DESCRIPTION OF THE PREFERRED EMBODIMENTS

Figure 1:
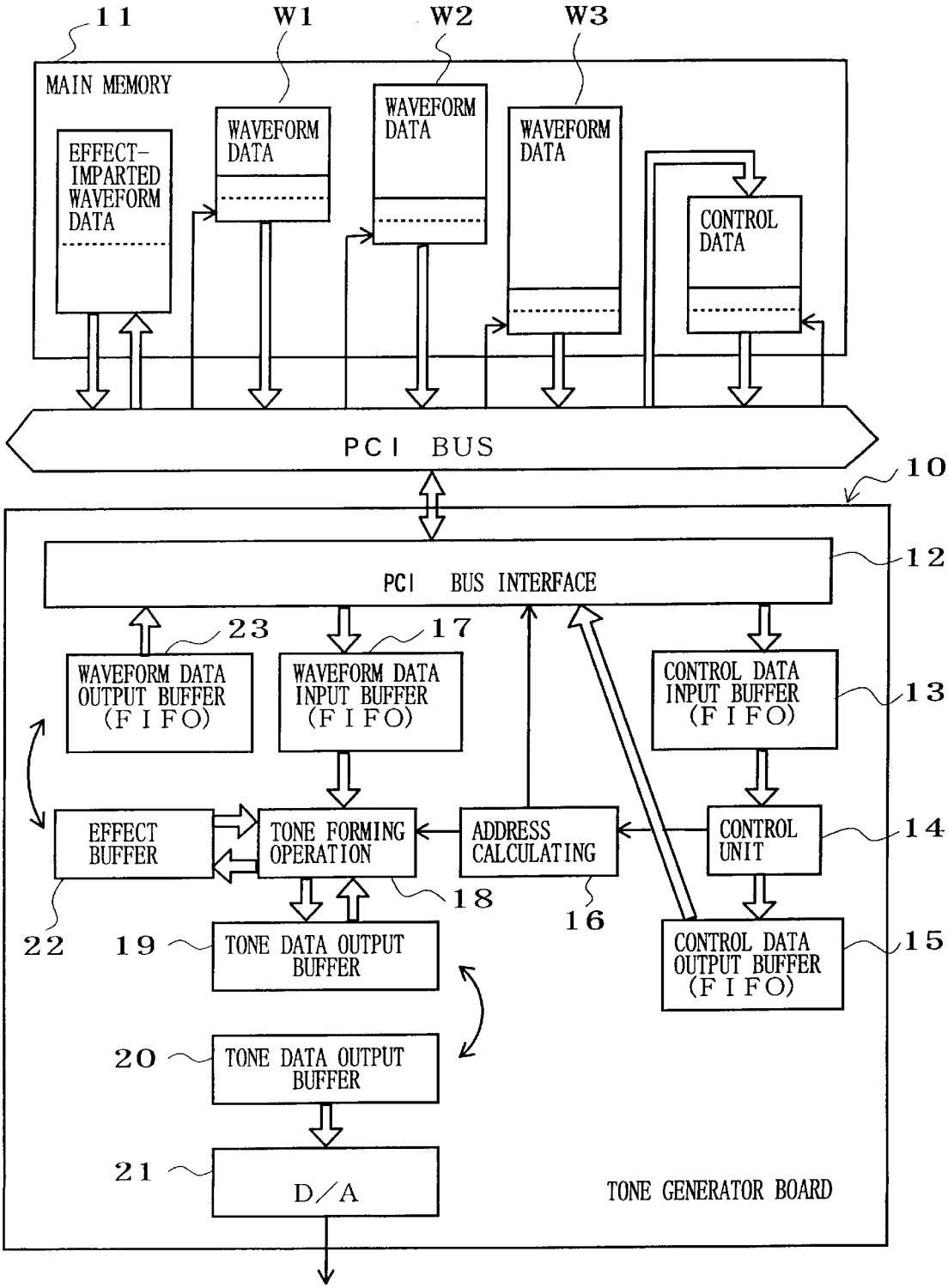
FIG. 1 is a hardware block diagram of a tone generator device according to a first embodiment of the present invention.

FIG. 1 is a block diagram of a tone generator device according to a first embodiment of the present invention. The tone generator device illustrated in FIG. 1 is applied to and operate in conjunction with a computer system by being connected to a PCI (Peripheral Component Interconnect) bus that is an extended bus of the computer system. Specifically, a tone generator waveform memory section in the embodiment is provided separately from a tone generator board section 10 and included in a main memory 11 of the computer system, and the tone generator waveform memory section is connected with the tone generator board section 10 via the PCI bus. It should be obvious that the tone generator board section 10 may be in the form of an extension card or the like provided with a PCI bus connector, or may be in the form of a circuit board mounted on a computer system board. Although not specifically shown in FIG. 1 for simplicity, the computer system includes various other components as conventionally known in the art.

The above-mentioned main memory 11, such as an EDO DRAM (i.e., Extended Data Output DRAM), is mounted on the computer system board and connected to the PCI bus. In the main memory 11 of the computer system, various programs and data are stored, such as a driver program (hereinafter called a "driver") for the tone generator device, application programs to operate the tone generator device via the driver, a plurality of sets of waveform data (e.g., waveform data sets W1 to W3) each including successive sample data of a tone, and control data for the tone generator device supplied from the driver and tone generator device. In response to activation of the computer system or entry of a specific instruction, these programs and data are read out from a secondary storage device, such as a hard disk, and then transferred to the main memory 11 for storage therein.

Each of the above-mentioned waveform data sets includes data indicative of an input sampling frequency used therefor (original sampling frequency, i.e., sampling frequency used for recording of the sample data) and a plurality of waveform sample data. According to the embodiment, the data indicative of the input sampling frequency is placed at the head of the waveform data set, and the waveform sample data are arranged in succession, at locations following the input sampling frequency data, in the order they were sampled. Further, the above-mentioned control data each contain parameters for controlling the tone generator device (e.g., parameters for setting or controlling tone pitch, volume and color, and parameters representing sound effects such as a reverberation) and are stored at successive locations in the main memory 11.

Here, various specifications in the embodiment are set forth, by way of example, to facilitate understanding of the present invention.

Assuming that the output sampling frequency of a D/A converter 21 on the tone generator board section 10 is 48 kHz, the processing cycle of the D/A converter 21 (DAC cycle) is $1/48{,}000$ sec., which corresponds to the sampling cycle of a tone signal ultimately output from the tone generator board section 10.

A length of time necessary for reproductively outputting 256 samples of tone signal amplitude in the DAC cycle will hereinafter be called a "frame", which is about 5.3 ($=256\times 1/48{,}000$) milliseconds in the above example. Also, a group of waveform data to be output per frame will be called a "block". The term waveform data "block" represents two concepts, "transfer block" and "output block". Whereas the time length of each frame is constant, the quantity of waveform sample data (the number of samples) to be contained in a single block, corresponding to one frame, generally differs between the transfer block and the output block.

The term "transfer block" is used herein to refer to a block of the waveform sample data to be transferred together by burst transmission (i.e., burst-transmitted) from the main memory 11 to the tone generator board section 10, which is equivalent to the number of samples of original waveform data necessary for reproductively outputting waveform data for one frame. In this embodiment, the data size (the number of samples) of the transfer block is variable as necessary. On the other hand, the term "output block" is used herein to refer to a block of waveform data to be reproductively output from the tone generator board section 10 within a single frame. In this embodiment, the data size (the number of samples) of the output block is fixed at, say, 256 samples.

If the original sampling frequency (i.e., sampling frequency used for recording) of the original waveform sample data stored in the main memory 11 is 48 kHz and the waveform data are to be reproductively output without changing the original tone pitch (i.e., without effecting any pitch shift), the number of the original waveform sample data necessary for reproducing waveform data up to the predetermined output block size of 256 samples will amount to 256, in which case the quantity of the waveform sample data to be contained in one transfer block will also amount to 256.

In contrast, if the same waveform data are to be reproductively output at a pitch one octave higher than the original tone pitch, then the number of the original waveform sample data necessary for reproducing waveform data up to the predetermined output block size of 256 samples will amount to 512, in which case the quantity of the waveform sample data to be contained in one transfer block will also amount to 512. In this case, a necessary waveform data conversion from the transfer block to the output block, i.e., a number-of-sample conversion per frame, is carried out by use of a data "thinning" operation. In the event that the same original waveform data are to be reproductively output at a pitch one octave lower than the original tone pitch, then the number of the original waveform sample data necessary for reproducing waveform data up to the predetermined output block size of 256 samples will be only 128 samples, in which case the quantity of the waveform sample data to be contained in one transfer block will also be 128 samples. In this case, the necessary waveform data conversion from the transfer block to the output block, i.e., the number-of-sample conversion per frame, is carried out by use of data "duplication". In most cases, however, the size (i.e., number of samples) of the transfer block is not an integer multiple relative to the size (i.e., number of samples) of the output block, so that a waveform sample interpolation technique is employed in this embodiment.

Address calculating section 16 of the tone generator board section 10 calculates a specific quantity of the waveform sample data (number of samples) per transfer block necessary for each frame and an address range of a particular transfer block to be transferred by burst transmission (i.e., burst-transmitted) within the frame, in consideration of the original sampling frequency (i.e., input sampling frequency) and a desired pitch of a tone to be generated (which is, in effect, a relative pitch to the original pitch of the original waveform data, i.e., a pitch shift amount indicating how much the original pitch is to be shifted). Then, the address calculating section 16 requests the main memory 11 to burst-transmit the waveform data within the thus-calculated address range, namely, the waveform sample data of a particular transfer block. The original sampling frequency serving as a basis of these calculations is given to the tone generator board section 10 as head data of the waveform sample data as stated earlier, and other data, such as the pitch of a tone to be generated, are given to the tone generator board section 10 as control data.

Further, the term "output block" represents two concepts, "channel output block" and "accumulated output block". In this embodiment, tone waveform data can be reproduced simultaneously in 96 channels on a time-divisional basis, and the "channel output block" means a block of the waveform data to be reproduced per channel by the tone generator board section 10 within a single frame and is composed of 256 samples of the waveform data for that channel. The samples of waveform data (waveform sample data) for the individual channels are summed in correspondence with each of the DAC cycles to provide a single sample of summed waveform sample data for each of the DAC cycles. Here, the "accumulated output block" means a sum of waveform sample data for 96 channels that are reproductively output from the tone generator board section 10 within a single frame.

The following paragraphs describe an example of a basic sequence of tone reproducing operations in the embodiment. Once there occurs an event instructing generation of a given tone, the computer system makes various preparations for generating the tone, which include allocating one of the channels for generation of the tone (alternatively, channel allocating information may be previously contained in event data), storing into the main memory 11 various control data necessary for the generation of the tone in the allocated channel, and transferring tone generator waveform sample data, to be used for the generation of the tone, from a secondary memory (waveform data base), such as a hard disk, to the main memory 11 unless such tone generator waveform sample data have already been stored in the main memory 11—if the tone generator waveform sample data have already been stored in the main memory 11, the computer system may directly use the stored tone generator waveform data. Then, in a next frame, the tone generator board section 10 retrieves from the main memory 11 the control data for the allocated channel, on the basis of which the section 10 issues a request for transfer of the waveform sample data of a first one of the transfer blocks necessary for reproducing the tone. In response to the request, the waveform sample data of the first transfer block are transferred from the main memory 11 to a waveform data input buffer 17 at a high speed by burst transmission via the PCI bus. Note that the block-by-block burst transmission is carried out, for each of the channels, within a frame period on the time-divisional basis (i.e., at different timing).

Then, via the address calculating section 16 and tone forming operation section 18, etc., control is performed such that the waveform data for one transfer block of the above-mentioned channel stored in the buffer 17 are read out, asynchronously with the DAC cycle and at a high speed, in accordance with their original sampling frequency (input sampling frequency) and a desired pitch (pitch shift amount). This way, a number-of-sample conversion is effected to generate 256 samples of the waveform data for one "channel output block". Also, each sample of the waveform data of the channel is cumulatively added with similarly generated waveform data of the other channels stored in a tone data output buffer (e.g., one denoted at reference numeral 19 in FIG. 1), and each added result is stored into a memory. The waveform data generating operations are carried out, for each of the channels, within a frame period on the time-divisional basis (i.e., at different timing). Namely, as soon as a transfer block of the waveform sample data for a given channel is collectively transferred by burst transmission into the waveform data input buffer 17, the waveform data generating operations are carried out for that channel. Similarly, as soon as a transfer block of the waveform sample data for another channel is transferred by burst transmission into the waveform data input buffer 17, the waveform data generating operations are carried out for the other channel. In this manner, 256 summed waveform sample data for one accumulated output block have been stored in the tone data output buffer (e.g., one denoted at reference numeral 19 in FIG. 1). Note that the waveform sample interpolation technique is employed, if necessary, in generating 256 waveform sample data for one channel output block.

Subsequently, in the next frame, the 256 summed waveform sample data having been stored in the tone data output buffer (e.g., one denoted at reference numeral 19 in FIG. 1) are sequentially read out therefrom in synchronism with the DAC cycle and then passed to the D/A converter 21. Then, similarly to the above-mentioned, via the address calculating section 16 and tone forming operation section 18, etc., the waveform data for the next or second transfer block of the above-mentioned channel are transferred by burst transmission for generation of 256 waveform data for one "channel output block" of that channel, and the thus-generated waveform data are added with waveform data of the other channels to thereby generate 256 summed waveform samples that are then stored into another tone data output buffer (e.g., one denoted at reference numeral 20 in FIG. 1).

The instructed tone generation can be carried out by repeating the above-mentioned operations on the frame-by-frame basis while alternating the read/write modes of the dual tone data output buffers 19 and 20 once every frame.

Now, a description will be given about an example setup of the tone generator board section 10 which is designed to carry out a tone generating process by accessing the main memory 11 via the PCI bus.

As shown in FIG. 1, the tone generator board section 10 includes a PCI bus interface 12 that is connected to the PCI bus and has a function of acting as a master of the PCI bus ("bus-master function"). The tone generator board section 10 also includes a FIFO (First-In First-Out)-type control data input buffer 13, which temporarily stores a control data block supplied from the main memory 11 via the PCI bus interface 12 and then sequentially outputs the individual control data of the block. Further, the tone generator board section 10 further includes a control unit 14 that controls the individual components of the tone generator device on the basis of the control data output from the control data input buffer 13. To this end, the control unit 14 instructs the address calculating section 16 to read out, from the main memory 11, control data to be executed thereby, and outputs, to a control data output buffer 15, control data to be returned to the computer system. The FIFO-type control data output buffer 15 temporarily stores the control data output from the control unit 14 and then passes the temporarily-stored control data to the PCI bus interface 12. Namely, the control unit 14 is arranged to voluntarily acquire the control data to be executed thereby, using the bus-master function performed by the PCI bus interface 12. The reason for providing the control data output buffer 15 is to save memory hardware on the tone generator board section 10, like the reason for providing a waveform data output buffer 23 as will be later described.

Namely, in the instant embodiment, control data to be used for controlling the tone pitch, volume, color, etc. at an initial tone-generating stage (first frame) are provided to the main memory 11 via a device driver (software program in the computer system), but control data for subsequent frames are created by the tone generator board section 10 and then written into the main memory 11. Thus, in the "n"th frame, control data created in the "n−1"th frame are read out from the main memory 11 to synthesize output samples, and control data for the "n+1"th frame are created and written into the main memory 11. Although the tone generator device is capable of simultaneously generating tones in 96 channels, the tone generator board section 10 is not provided with a memory capacity enough for retaining the control data for each of the channels up to the next frame; in other words, it is sufficient that the control data input buffer 13 have a capacity for storing the control data for just one channel. This arrangement is also intended f cutting down the cost of the tone generator device.

To summarize, each frame is divided into 96 channels, in each of which 256 samples are generated. In generating a tone in a given channel, the control data necessary for generating the 256 samples are first transferred from the main memory 11 to the control data input buffer (FIFO) 13 via the PCI bus, and then a predetermined number of the waveform sample data specified by the pitch control data are transferred from the main memory 11 to the waveform data input buffer (FIFO) 17 via the PCI bus. Then, 256 samples are generated at a stretch on the basis of the control and waveform sample data thus transferred, and, if necessary, the control data are renewed and transferred by way of the control data output buffer (FIFO) 15 back to the main memory 11 via the PCI bus; that is, if the control data are to be varied over time, then the values of the control data will be renewed on the frame-by-frame basis.

The address calculating section 16 calculates addresses for reading out or writing desired data on the main memory 11 via the PCI bus interface 12. Further, the address calculating section 16 instructs the tone forming operation section 18 to fetch data from the waveform data input buffer 17, as will be described later. The data readout, by the address calculating section 16, from the main memory 11 is conducted in the following manner. Upon occurrence of a new note-on event, the address calculating section 16 instructs burst transmission of a transfer block by supplying the PCI bus interface 12 with a leading or head address of one of the waveform sample data sets corresponding to a basic tone color and a specific number of the waveform sample data to be contained in the transfer block calculated on the basis of a relative pitch of a to-be-generated tone to the original tone pitch (i.e., pitch shift amount) and the input sampling frequency. During sounding of the tone, the address calculating section 16 instructs burst transmission of further transfer blocks following the first-transmitted transfer block. In the situation where the input sampling frequency is 48 kHz, the number of the waveform sample data to be contained in the transfer block amounts to 256 when no pitch shift is to be effected, 512 when a one-octave upward pitch shift (pitch-up) is to be effected, and 1,024 when a two-octave upward pitch shift (pitch-up) is to be effected.

The waveform data input buffer 17 is also a FIFO-type buffer memory, which temporarily stores a waveform data block that is supplied via the PCI bus interface 12 from the main memory 11 in response to address designation by the address calculating section 16 and then sequentially outputs the individual waveform sample data of the block. On the basis of the waveform data blocks sequentially supplied from the waveform data input buffer 17, the tone forming operation section 18 forms a tone as instructed by the control unit 14 via the address calculating section 16.

The capacity or size of the waveform data input buffer 17 must be chosen appropriately, since too small a capacity of the buffer 17 would impose a limit on the upward pitch shift capability although a small capacity is generally preferred from the viewpoint of the device's cost. The tone forming operation section 18 sequentially accumulates values (containing decimal portions) corresponding to the relative pitch (i.e., pitch shift amount), and reads out two samples, corresponding to the integer portion of the accumulated value and a next relative-pitch-corresponding value, from the waveform data input buffer 17 to thereby linearly interpolate, in the conventional manner, between the two samples using a value corresponding to the decimal portion thereof. For a tone color whose input sampling frequency is 48 kHz, if no pitch shift is to be effected, then the value corresponding to the relative pitch is "1" so that the output from the waveform data input buffer 17 directly becomes a channel output block. If the pitch is to be lowered to a half of the original pitch, then the value corresponding to the relative pitch is "0.5", and two samples, corresponding to the integer portion of the accumulated value and a next relative-pitch-corresponding value, are read out to linearly interpolate between the two samples, in which case the samples stored in the waveform data input buffer 17 are used in an overlapping manner, and thus control has to be performed to temporarily stop advancement of an output pointer associated with the waveform data input buffer 17. Further, if the pitch is to be raised by a factor of 2.5, then the value corresponding to the relative pitch is "2.5", in which case some of the generated samples are left unused so that control has to be performed to jump the output pointer for the waveform data input buffer 17. Namely, generally speaking, where the output pointer associated with the waveform data input buffer 17 is controlled by incrementing operations of a frequency number (or address increment) F, it is sufficient that the frequency number F be set to equal a quotient of "(the number of samples in the transfer block)÷(the number of samples in the output block)" and the output pointer be controlled by the integer portion of the cumulatively incremented value qF and an interpolation coefficient be determined from the decimal portion.

Figure 4:
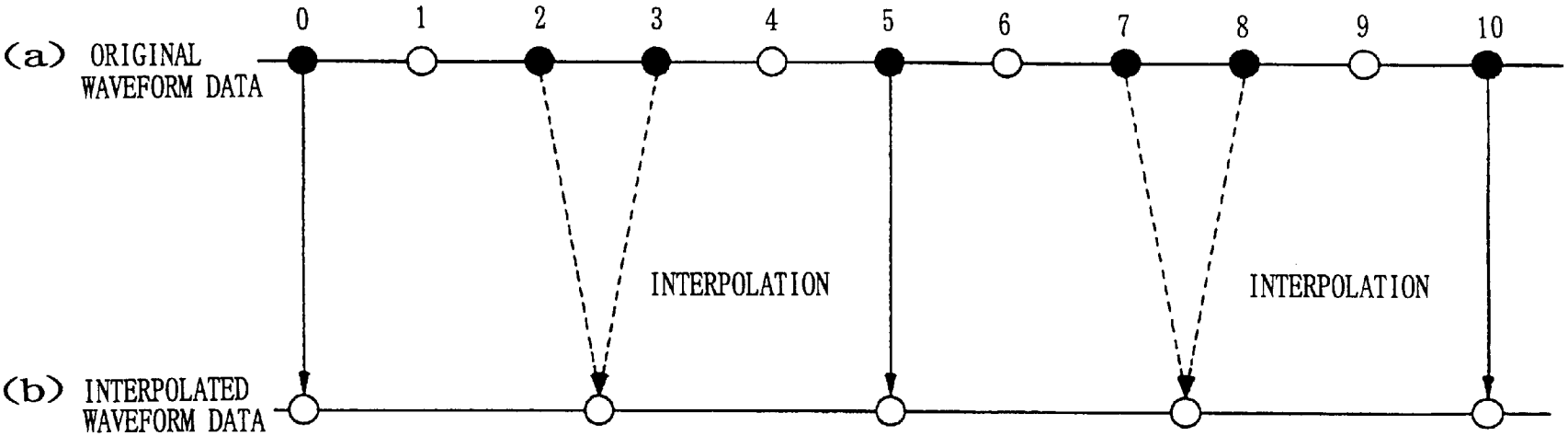
FIG. 4 is a diagram showing an exemplary manner in which waveform sample interpolating operations are carried out in the first embodiment.

FIG. 4 is a diagram showing an exemplary manner in which a waveform sample interpolation is carried out to generate a tone waveform with a pitch-up from the original waveform; more specifically, this figure shows an example where a tone is generated at a pitch higher than the original waveform by 1.3 octave (in frequency, two and a half (2.5) times the original waveform). At (a) of FIG. 4, circular dots represent successive waveform sample data in a transfer block to be stored in the waveform data input buffer 17. At (b) of FIG. 4, circular dots represent successive waveform sample data in a channel output block generated by interpolating arithmetic operations. Because the pitch shift to be effected here is upward (pitch-up), the waveform sample data readout from the input buffer 17 involves "data thinning". At (a) of FIG. 4, white circular dots each represent a sample to be skipped (namely, a sample to be left unread), while black circular dots each represent a sample to be read out. Further, dotted-line arrows, pointing from (a) to (b), each indicate that two adjoining samples are synthesized by interpolation. In the illustrated example, the frequency number F is "2.5", and thus its cumulatively incremented value gF sequentially varies as follows: "0", "2.5", "5", "7.5", "10", . . . . During that time, the output pointer associated with the waveform data input buffer 17 is also sequentially advanced in correspondence with the integer-portion values "0", "2.", "5", "7", "10", . . . , so that the waveform sample data at sample points "0", "2.", "5", "7", "10", . . . are sequentially read out; at each point containing a decimal portion, the waveform sample data at adjoining sample points are synthesized by interpolation in accordance with the decimal-portion value.

Because the same waveform data input buffer 17 is shared among the channels, it is likely that the waveform sample data of a given channel will be transferred to the input buffer 17 concurrently with a tone forming process performed by the tone forming operation section 18 for a preceding channel. Thus, the waveform data input buffer 17 may be implemented by another type of buffer than the FIFO type, such as a double or dual buffer.

Figure 2:
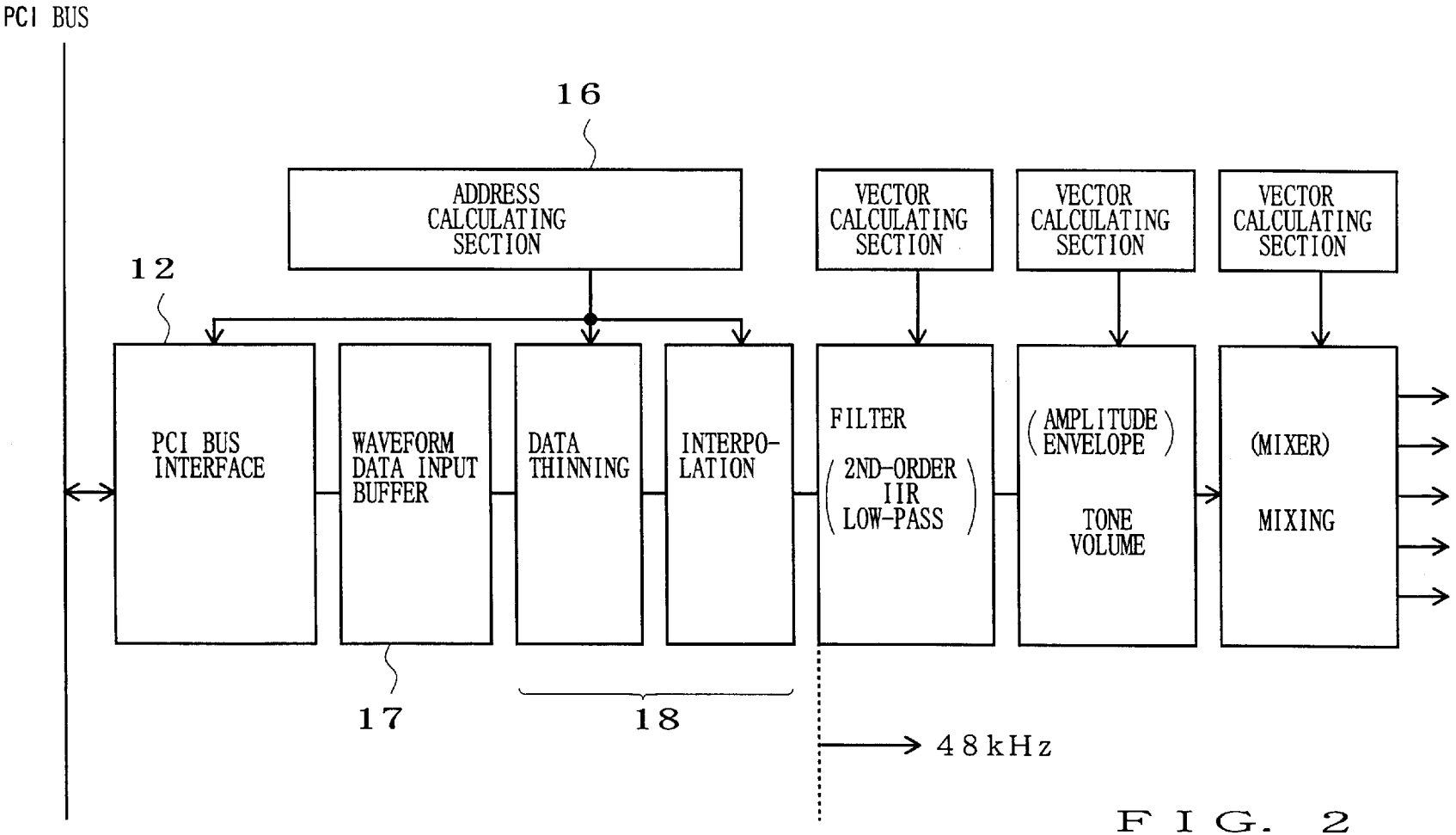
FIG. 2 is a block diagram illustrating control and data flows in a tone generating process carried out by the tone generator device of FIG. 1.

Further, the following paragraphs describe the tone forming process with reference to FIG. 2, where elements similar to those in FIG. 1 are denoted by the same reference characters as used therein. Each of the waveform data blocks output from the waveform data input buffer 17 is passed to the tone forming operation section 18, where it is converted into a waveform data block having a 48 kHz sampling frequency by being subjected to a data thinning-out/interpolating operation. Specifically, the waveform data block conversion is executed by a pitch change operation based on data supplied from the address calculating section 16.

Each of the waveform sample data sets includes, at its head address, data indicative of the input sampling frequency used therefor as noted earlier, and the address calculating section 16 retains this input sampling frequency data until after all operations using the waveform sample data set are completed. The address calculating section 16 gives the input sampling frequency data to the tone forming operation section 18 at timing when the waveform data block associated with (or preceded by) the sampling frequency data is to be supplied to the operation section 18. For example, in a situation where the input sampling frequency data represents an 8 kHz frequency and the output sampling frequency is 48 kHz, the tone forming operation section 18 lowers the pitch of the waveform data block from the waveform data input buffer 17 by a factor of 6 (8/48). Thus, an appropriate tone pitch can be maintained even when the waveform data block is treated as data of 48 kHz; that is, the sampling frequency conversion can be treated in virtually the same way as pitch conversion in the tone formation.

Note that mere reproduction of the waveform sample data and the tone forming process based on the waveform sample data differ from each other, such as in terms of whether the waveform data are to be sounded only one time ("Stream Mode" performance) or a plurality of times repetitively ("Static Mode" performance). In the present embodiment, a combination of the Stream Mode and Static Mode performances may be employed (e.g., the Stream Mode performance may be used for the attack portion, while the Static Mode performance may be used for the succeeding portions), and the driver permits switching between the Stream Mode and Static Mode performances so that the tone generator device is allowed to carry out various operations without a need to consider the nature of input waveform data.

The waveform data block having its sampling frequency converted in the above-mentioned manner is subjected to a filtering operation using a low-pass filter (LPF), tone volume control operation, mixing operation, etc. in accordance with instructions from the control unit 14. To allow the values of the control data to smoothly vary over time, each of a plurality of vector calculating sections in FIG. 2 executes interpolating arithmetic operations and the like on the control data, given for each of the waveform data blocks, to thereby calculate control data for each waveform sample, and it feeds the thus-calculated control data to various components of the tone generator device.

As further shown in FIG. 1, the tone generator device also includes an effect buffer 22 and a FIFO-type waveform data output buffer 23, which together allow waveform data, synthesized by the tone forming operation section 18, to be transmitted from the output buffer 23 to the computer system by way of the PCI bus so that the synthesized waveform data is imparted a tonal effect, e.g., a reverberation effect, by the computer system. According to the present embodiment, the driver operating in the computer system executes the effect impartment, and the resultant effect-imparted waveform data is stored into the main memory 11 and transferred back to the tone generator board section 10 via the PCI bus in a similar manner to the other waveform sample data. Namely, the present embodiment attempts to cut down the cost of the tone generator device, by using resources (such as the main memory 11) of the computer system to implement a delay memory and other elements necessary for the effect impartment. In one preferred implementation, the effect-imparted waveform sample data transferred back from the computer system to the tone generator device may be re-transmitted to the computer system so that the system again executes the the effect imparting operation on the same waveform sample data and then again sends the resultant waveform sample data back to the tone generator board section 10. Namely, the waveform sample data may be subjected to the effect imparting operation a plurality of times in a looped fashion.

Whereas a tonal effect may be imparted separately for each of the channels, the present embodiment is arranged to mix the waveform sample data of two or more channels at desired mixing proportions so that a tonal effect can be imparted to the mixed waveform. The above-mentioned effect buffer 22 is provided for temporarily storing one-frame waveform sample data that are to be imparted a same or common tonal effect. When a tonal effect is to be imparted only for one channel, the waveform sample data for that channel is temporarily stored into the effect buffer 22 and then sent back to the computer system via the waveform data output buffer 23. When, on the other hand, a tonal effect is to be imparted to a mixture of the waveform sample data of two or more channels, the waveform sample data of these channels mixed at desired mixing proportions are temporarily stored into the effect buffer 22 and then sent back to the computer system via the waveform data output buffer 23. Then, the waveform sample data having been imparted the effect by the computer system are stored into an effect-imparted waveform storage area of the main memory 11 and subsequently transferred by burst transmission to the tone generator board section 10 in response to a transfer request issued therefrom. Note that any particular one or ones of the channels for which a reverberation effect is to be imparted are designated by the control data.

Figure 3:
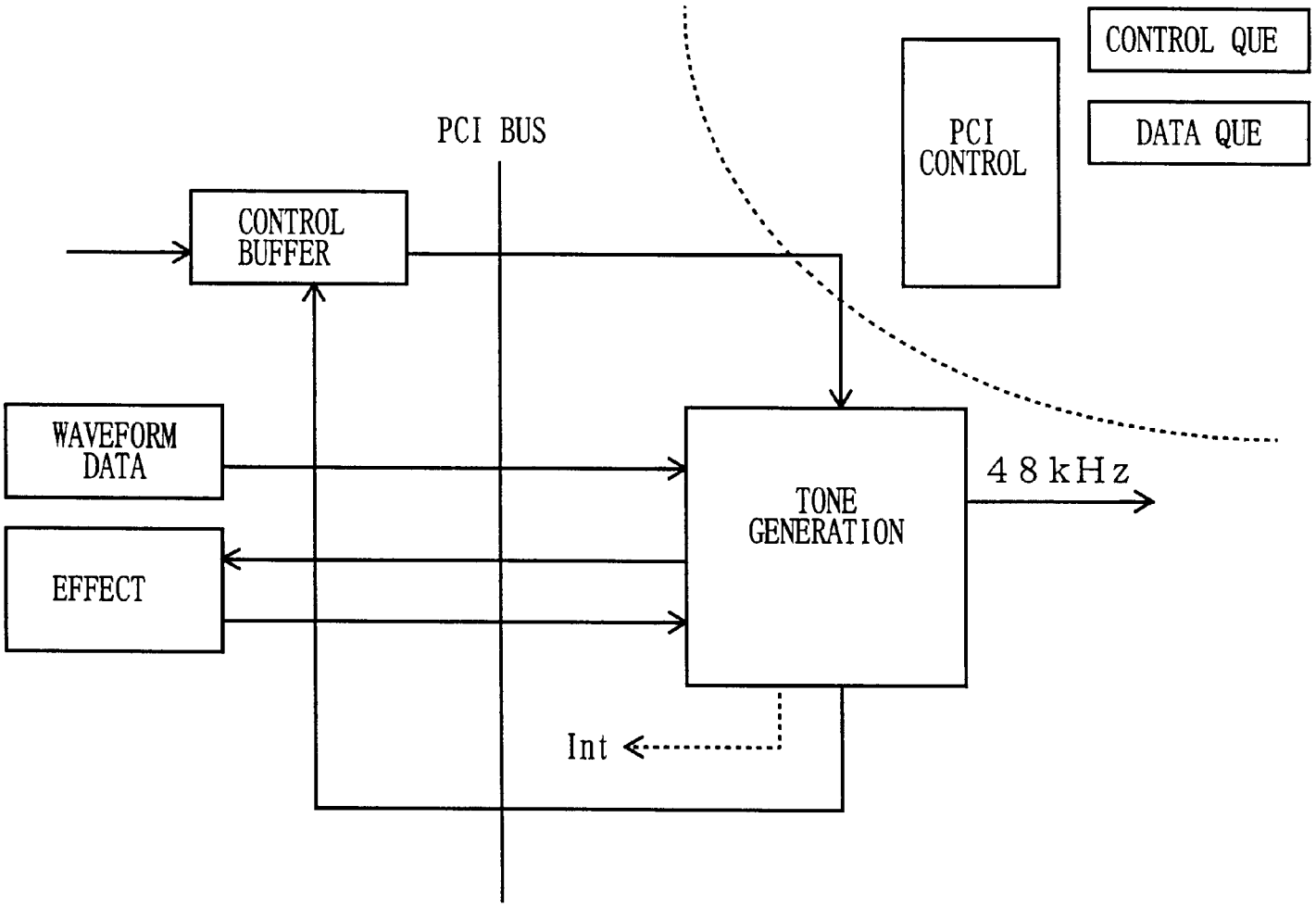
FIG. 3 is a block diagram illustrating flows of various data communicated via a PCI bus in the tone generator device.

FIG. 3 is a block diagram illustrating flows of various data in the present embodiment. The left half portion of FIG. 3 represents the computer system, while the right half portion represents the tone generator board section 10. Further, there are shown two types of transmission line for data to be communicated via the PCI bus: transmission lines for the waveform sample data represented in heavy solid line; and transmission lines for the control data represented in light solid line. As may be clear from the figure, to impart a specific effect to waveform sample data, the waveform sample data is sent from the tone generator board section 10 to the computer system for the effect impartment operation and then returned to the tone generator board section 10. "CONTROL BUFFER" in the figure corresponds to an area of the main memory 11 of FIG. 1 in which are stored the control data, "PCI CONTROL" corresponds to the PCI bus interface 12, "CONTROL QUE" to the control data input buffer 13, and "DATA QUE" to the waveform data input buffer 17.

Referring again to FIG. 1, the tone data output buffers 19 and 20 each have a total capacity or size of, say, "16 bits×256 samples". Either one of the tone data output buffers sequentially accumulates outputs from the tone forming operation section 18 while the other tone data output buffer sequentially outputs its stored contents. These two tone data output buffers 19 and 20 are used successively in an alternating manner such that their functions are reversed or alternated once a predetermined quantity of data have been output or accumulated. Specifically, one of the tone data output buffers 19 or 20 having been used for the data output function is switched to the data accumulation function only after its stored content is fully cleared therefrom. The D/A converter 21 converts digital data into an analog signal, and it is assumed here that this D/A converter 21 operates only on the 48 kHz sampling frequency.

Here, an additional description will be made about the control data. As noted earlier, it is sufficient that the main memory 11 be arranged to store the control data for one frame (namely, one block) and each of the control data input buffer 13 and control data output buffer 15 be arranged to store the control data for one channel. When the values of the control data are to be varied over time, the control unit 14 changes the value of the control data for a given frame, read out from the control data input buffer 13, to thereby generate control data for a next frame, temporarily stores the created control data, and then sends it back to the main memory 11 via the PCI bus. Therefore, the value of the control data to be transferred from the main memory 11 in the next frame differs from that of the preceding frame. If the value of the control data does not vary during the course of a frame but varies only at a switching point between adjoining frames, the control data will present discontinuous value variations, which may lead to a not-so-desirable result depending on the nature of the control data. To avoid this, it is only necessary that the control data for one frame to be transferred from the main memory 11 comprise a large number of data such that its value varies at a plurality of points within the frame; however, this approach is not preferable in that the storage capacities of the control data input buffer 13 and control data output buffer 15 have to be increased accordingly. This is the reason why the tone generator board section 10 includes the vector calculating sections as shown in FIG. 2.

More specifically, the main memory 11 has prestored therein values of the control data at the first and last sample points of the frame, and these prestored values are transferred to the control data input buffer 13. Then, the vector calculating sections of the control unit 14 perform interpolating arithmetic operations (e.g., linear interpolation) between the control data values at the first and last sample points of the frame to thereby calculates values of the control data for all of the 256 samples in the frame. In this way, control data values which time-vary smoothly at the individual sample points are calculated and will be used in the address calculating section 16, tone forming operation section 18, etc. Of course, values of the control data at the first and last sample points of a next frame are calculated simultaneously, and sent via the PCI bus to the main memory 11 after being temporarily stored in the control data output buffer 15. Such vector calculating operations are of course executed for each type of the control data, such as filter coefficient, tone volume envelope, mixing coefficient and pitch information, as shown in FIG. 2.

The following are additional explanations about the above-described embodiment:

(1) Reason why the PCI bus is used as an extended bus:

In addition to the low data transfer rate as noted earlier in relation to the conventional techniques, the ISA (Industry Standard Architecture) bus would present several significant drawbacks that it only permits access to a very narrow range of memory space (16 MB) because of its 24-bit address bus width, a general-purpose DMA (Direct Memory Access) controller of relatively low operating speed has to be used due to its poor bus-master function, and the CPU is subject to relatively great loads.

The PCI bus is an improved form of extended bus intended to minimize the aforementioned drawbacks of the ISA bus and includes data and address buses each having a 32-bit (or 64-bit) width. Further, the operating clock frequency of the PCI bus is 33 MHz, which would provide for a theoretical maximum data transfer rate of 132 MB/sec. (or 264 MB/sec.) Furthermore, the bus-master function supported by the PCI bus can substantially reduce the loads on the CPU and on a highspeed DMA that is not controlled by a general-purpose DMA controller. Therefore, it can be said the PCI bus has given a sufficient solution to the drawbacks of the ISA bus that used to be significant obstacles to an efficient data transmission.

In addition, the PCI bus has a burst transmission mode which is not supported by the ISA bus and in which a plurality of data are transmitted collectively in succession in response to one address designation. Use of such a burst transmission mode provides for high-speed readout of successive data from a DRAM (Dynamic RAM) also having a burst transmission mode. The PCI bus has an additional advantage that an interface to be connected to the bus can be manufactured at reduced cost. The foregoing are the primary reasons why the PCI bus is used in the described embodiment; however, any other forms of extended bus than the PCI bus may be employed as long as they have characteristics similar to those of the PCI bus.

(2) Reason why the EDO DRAM is used:

The EDO (Extended Data Output) DRAM is a form of DRAM which includes a data hold circuit at a stage preceding its data output terminal so that data readout from individual memory cells within the DRAM and data output to the system bus can be effected in an overlapping manner so as to reduce a necessary cycle time. The EDO DRAM also has a burst transmission mode, which, where the operating clock frequency of the system bus is, say, 66 MHz, provides for one burst transmission per two clock pulses (namely, each burst transmission occurring at a 33 MHz frequency). Thus, where data are output by way of the PCI bus operating in the burst transmission mode, it is possible to achieve burst transmission involving no substantial wait time. Of course, any other forms of DRAM than the EDO DRAM, such as a BEDO (Burst EDO) DRAM and S (Synchronous) DRAM, may be used in cases where burst transmission based on the operating clock of the extended bus is possible at all.

(3) Reason why the waveform sample data are transferred on the block-by-block basis:

According to the PCI bus scheme, the same bus is used as the address bus and the data bus on a time-divisional basis; thus, normally, each data is received via the same bus that has been used to send its address. In such a case, the maximum data transfer rate would be reduced by half (i.e., down to 66 MB) even though the tone generator device is allowed to exclusively use the PCI bus. In view of possible scramble or struggle with other equipment for the bus, the data transfer rate could never be sufficient to simultaneously generate more than one hundred tones, although it is by far higher than that achieved via the ISA bus.

To avoid the inconvenience, the above-described embodiment of the invention is arranged in such a manner that the tone generator device conducts data processing on the block-by-block basis with the PCI bus placed in the burst transmission mode. With the arrangement, by transmitting only the leading address, data (data blocks) stored at and after the leading address can be received successively in predetermined order. Thus, in the PCI bus, the necessary address transfer time can be reduced extremely and the data transfer time will occupy most of the total time required. Further, because the tone generator device can exclusively use the PCI bus during the burst transmission and because the waveform sample data are stored in memory (e.g., EDO DRAM) capable of burst transmission based on the same clock as the operating clock of the PCI bus, the data transfer rate of the waveform sample data via the PCI bus can be quite close to the theoretical value (132 MB/sec. or 264 MB/sec.).

(4) Reason why the tone waveform data are calculated on the block-by-block basis:

In the described embodiment, the waveform sample data are read out from memory on the block-by-block basis. Thus, with the conventional processing technique which starts calculating tone waveform data only after waveform sample data of all tones to be simultaneously generated have been completely read out, the tone waveform data calculation can not be conducted in time for predetermined tone generation timing and there would occur an unwanted break in generated tones, in cases where the number of the tones to be simultaneously generated is relatively great or the quantity of data to be transmitted via the PCI bus is relatively great (i.e., the input sampling frequency is relatively high).

As noted earlier, the burst transmission mode should be used in transmitting waveform sample data via a PCI bus, and the described embodiment is so designed for efficiency purposes. However, because too small a block size (unit quantity) of waveform sample data would limit the benefit (enhanced data transfer rate) afforded by the burst transmission, we should not reduce the block size more than a certain degree. Also, as many simultaneously-generatable tones as possible should be guaranteed, because the number of simultaneously-generatable tones is one of the major factors representing the performance of the tone generator device. Namely, the number of simultaneously-generatable tones and the block size should be positively increased for enhanced performance of the tone generator device; however, such a positive increase could not be expected where the conventional processing technique is applied simply just as it is.

For an increase in the number of simultaneously-generatable tones and the block size, the described embodiment is arranged to calculate tone waveform data on the block-by-block basis for each of the channels and accumulate the thus-calculated tone waveform data in the tone data output buffers, to provide ultimate tone waveform data. Of course, in the embodiment as well, the ultimate tone waveform data are determined after readout of the waveform sample data of the individual blocks corresponding to a total "n" number of channels to be simultaneously generated; however, the embodiment of the invention differs from the conventional processing technique in that the tone waveform data calculating process is initiated on a transfer block of the first channel while this block is being read out. Namely, in the described embodiment, the tone waveform data calculating process will be terminated immediately after readout of a transfer block of the "n"th channel.

(5) Reason why two tone data output buffers are provided:

In the described embodiment, the tone waveform data calculating process is carried out on the block-by-block basis in predetermined order, as noted above. Tone waveform data may of course be sequentially sent to the D/A converter in a rare situation where only one tone is to be generated at a time; however, in practice, the tone waveform data are calculated ahead of their generation (i.e., sounding) timing because two or more tones have to be simultaneously generated in normal cases. Thus, there arises a need for a tone data output buffer for temporarily storing the data of the individual tones.

However, providing as many tone data output buffers as the number of tones to be simultaneously generated would considerably increase the manufacturing cost. To avoid the cost increase, the described embodiment includes one tone data output buffer capable of storing the waveform sample data of a single accumulated output block and is arranged to accumulate the tone waveform data of the individual blocks in this output buffer. More specifically, where the number of channels to be used for simultaneous generation of tones is "n", the waveform sample data block of the first channel is initially written into the output buffer, after which the subsequent tone waveform data blocks up to the waveform data block of the "n"th channel will be cumulatively added or stored into the output buffer in predetermined order.

But, naturally, the tone data output buffer can not output the tone waveform data during the time when the data blocks are being cumulatively stored therein. For this reason, the present embodiment employs an additional tone data output buffer so that the functions of the two tone data output buffers are sequentially alternated such that when one of the output buffers is being used for the cumulative data storage, the other output buffer can be used for the data output. With this dual output-buffer arrangement, it is possible to reliably avoid an unwanted break in the output tones.

(6) Reason for provision of the data input buffers:

Whereas the tone generator device is allowed to exclusively use the PCI bus in the burst transmission mode as stated above, it still has to undergo some struggle for the bus before it is successfully placed in the burst transmission mode. Naturally, the tone generator device might sometimes fail to secure the right to use the bus, in which case there would arise a need to prevent a break in the generated tones. It is of course likely that the data transfer will lag behind the tone generating process as long as a general-purpose bus is used, but the possibility of of such a lag can be reduced. Specifically, to reduce the possibility, the described embodiment is arranged to read out the necessary waveform sample data ahead of the tone generating process to temporarily store them in FIFO buffers 13 and 17 and then use the buffered waveform sample data in the tone generating process. Note that the size of the FIFO buffers 13 and 17 may be appropriately set on the basis of the biggest possible size of the transfer block of at least one channel.

In summary, with the tone generator device of the present invention having so far been described, it is possible to employ high-speed burst transmission over an extended bus such as a PCI bus and achieve sufficiently high performance without a built-in waveform memory, by allowing delays in tone generation and treating waveform sample data on the block-by-block basis. Besides, by properly setting the size of the blocks, the tone generating delays can be reduced to such a degree to prevent listeners from feeling some disorder. Further, because it is not necessary to provide as many tone data output buffers as the number of tones to be simultaneously generated, the tone generator device can be manufactured at reduced cost.

Furthermore, the provision of the waveform data input buffer can effectively avoid an unwanted break in generated tones even when the tone generator device is defeated in struggle for a general-purpose extended bus. Moreover, with the arrangement that the control data are read out from the computer system, the manufacturing cost can be even further reduced, and the use of the bus-master function, for example, can effectively lessen the loads on the CPU.

To enhance the efficiency of the burst transmission from the main memory 11 to the waveform data input buffer 17 and to raise the upward pitch shift (pitch-up) capability, it is desirable that the waveform data input buffer 17 have a relatively great size or capacity; however, for a reduced cost, it is preferred to minimize the capacity of the waveform data input buffer 17. For that purpose, the following paragraph describes an approach to raise the maximum pitch-up capability with the waveform data input buffer 17 having a relatively small capacity, assuming that the capacity equals a dual-buffer size of 2,000×2.

While a transfer block necessary for calculating 256 samples for a channel output block is transferred by burst transmission, the maximum number (i.e., greatest possible number) of the waveform sample data in the transfer block is set to 2,000. That is, the maximum pitch-up capability is set to three octaves because dividing 2,000 by 256 (2,000/256) gives about 8; in practice, however, this maximum capability would be lowered to about two octaves due to an alignment loss in the data transfer. To raise the maximum pitch-up capability in such a memory environment, the embodiment is designed to carry out the following operations in conjunction with the device driver (software program). Namely, the device driver is triggered upon activation of the computer system's OS (Operating System) and then requests the OS to reserve a predetermined memory area for storing the waveform sample data from the hard disk or the like. At that time, thinned waveform sample data having different cycles, which correspond to ½, ¼ and ⅛ of the cycle of the original waveform, are prepared and stored into the main memory 11 along with the original waveform sample data. Then, during reproductive sounding, a shift is made from one waveform to another each time the designated pitch is raised by one octave and the other (shifted-to) waveform is transferred to the waveform data input buffer 17. The waveform data input buffer 17 can cover up to four octaves with this octave-by-octave waveform switching scheme; for the last-mentioned ⅛-cycle waveform, the waveform data input buffer 17 can deal with an upward shift over a total of six octaves by use of an additional two-octave pitch-up which is the maximum affordable by the hardware. Note that to this end, it is necessary to change pitch-corresponding data, depending on the thinned waveform used.

For a tone color whose input sampling frequency is relatively low, the maximum pitch-up capability can be raised by preparing a smaller number of the thinned waveform sample data or without preparing such thinned waveform sample data at all. For example, for a tone color whose input sampling frequency is 8 kHz, the pitch can be increased from the original by a factor of 6 by just sequentially reading its waveform samples at a frequency of 48 kHz.

Now, a description will be made about a second embodiment of the present invention, which corresponds to a more detailed version of the aforesaid modification and is characterized by preparing plural different sorts of thinned waveforms so that a range of reproducible tones can be expanded by using an optimum thinned waveform in accordance with a desired pitch-up amount.

Figure 5:
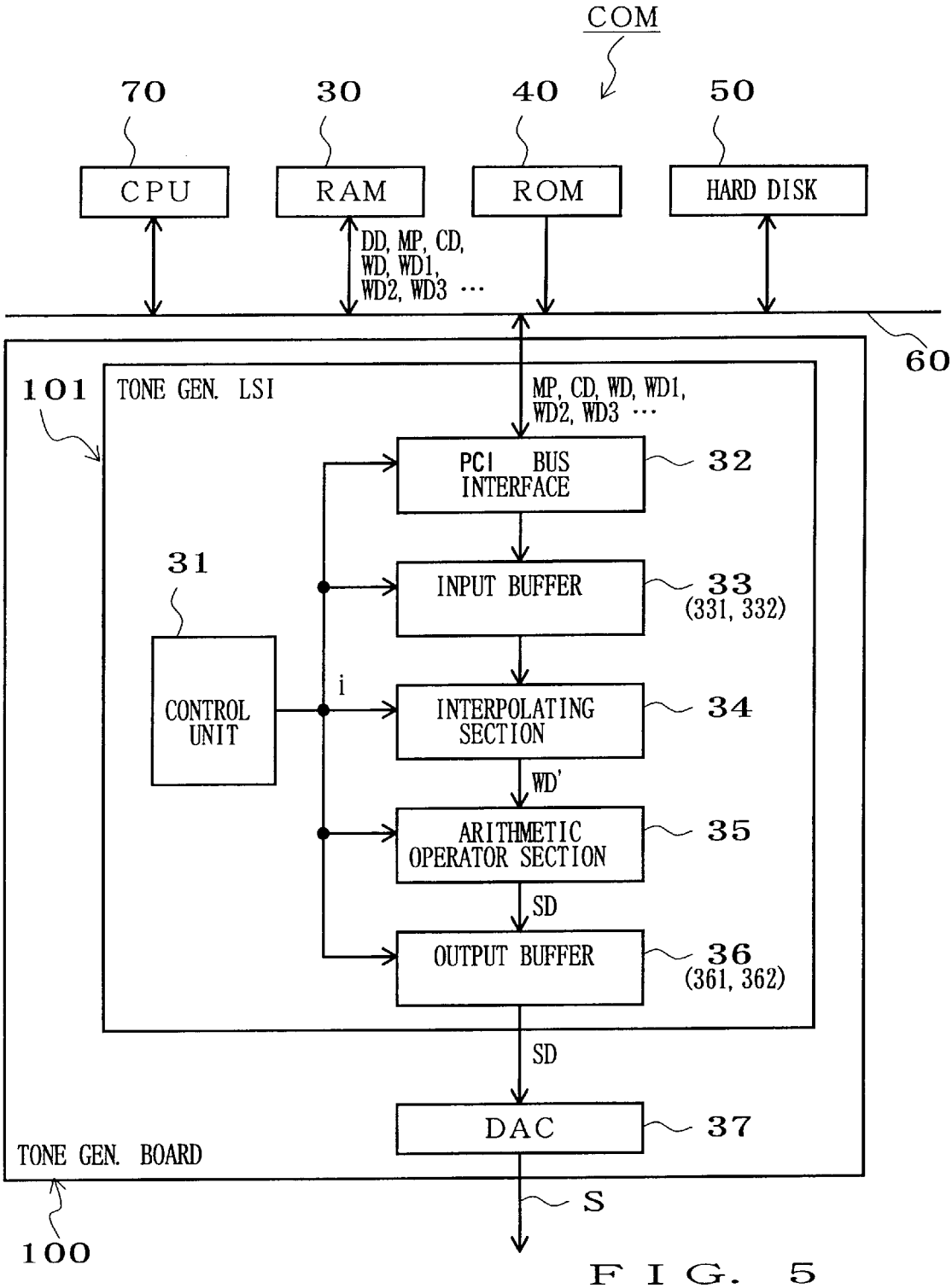
FIG. 5 is a block diagram of a computer system in accordance with a second embodiment of the present invention.

FIG. 5 is a block diagram of a computer system COM in accordance with the second embodiment, where a CPU 70 is connected with various components via a bus 60 and controls overall operations of the computer system COM. RAM 30 is a readable/writable memory corresponding to the above-mentioned main memory 11 of the first embodiment and functions as working areas for the CPU 70. ROM 40 is a read-only memory where a boot program and the like are prestored. Further, a hard disk 50 functions as a secondary storage device, which has prestored therein various programs such as application programs, device driver DD and microprograms MP as well as various data such as control data CD and waveform sample data WD and into which other programs and data can be loaded from the RAM 30 as necessary.

Here, the control data CD include tone color information (i.e., addresses where waveform sample data WD corresponding to a given tone color is stored), pitch information and tone volume information. The waveform sample data WD comprise data obtained by sampling a tone that was actually performed by a musical instrument corresponding to a particular tone color such as that of guitar or piano. The pitch information is represented by an actual number, containing a decimal portion, that is determined by an original pitch of the waveform sample data WD, sampling frequency used for recording the waveform sample data WD, desired pitch of to-be-reproduced tone waveform data SD and output sampling frequency (DAC rate). In a situation where the sampling frequency used for recording the waveform sample data WD is equal to the output sampling frequency (e.g., 48 kHz), then the pitch information is "1" when the desired pitch of to-be-reproduced tone waveform data SD is equal to the original pitch of the waveform sample data WD and "2" when the desired pitch of to-be-reproduced tone waveform data SD is one octave higher than the original pitch of the waveform sample data WD.

Upon activation of the OS, the device driver DD, microprograms MP, waveform sample data WD, etc. are delivered via the bus 60 to the RAM 30, and the control data CD designated by a higher-order application program are also sent to the RAM 30 as necessary. Also, the microprograms MP stored in the RAM 30 are transferred to a tone generator LSI 101. Although the bus 60 may be of any desired type as long as it is capable of transferring a large quantity of data at high speed, it is assumed here to be a PCI (Peripheral Component Interconnect) bus equipped with a burst transmission mode.

Figure 6:
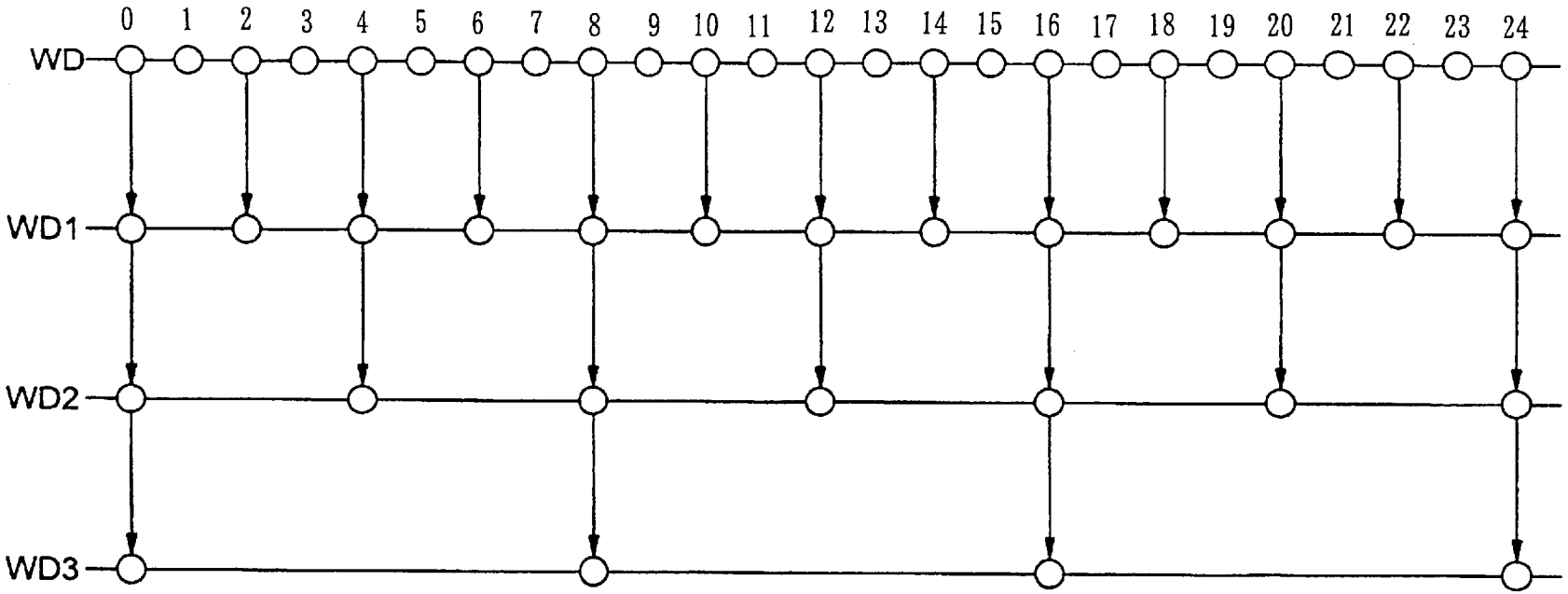
FIG. 6 is a diagram showing an exemplary relationship between original waveform data and thinned waveform data in the second embodiment.

In this embodiment, all of the waveform sample data sets WD originally stored in the hard disk 50 are not necessarily transferred and stored into the RAM 30, but only some of the waveform sample data sets WD corresponding to frequently used tone colors are stored into the RAM 30 and exchanged between the RAM 30 and the hard disk 50 as necessary. Upon activation and at the time of exchange of the waveform sample data WD, the device driver thins out the waveform sample data WD transferred from the hard disk into a half the original number of the samples on an octave-by-octave basis to thereby provide thinned waveform sample data sets WD1, WD2, WD3, . . . , which are then stored into the RAM 30. FIG. 6 is a diagram showing an exemplary relationship between the original waveform sample data set WD and the thinned waveform sample data sets WD1, WD2, WD3, where the horizontal axis represent sample points and numbers "0, 1, 2, 3, . . . " at the top of the figure represent successive sample points of the original waveform sample data set WD. The thinned waveform sample data set WD1, for example, comprises waveform sample data at even-numbered sample points 0, 2, 4, . . . with waveform sample data at odd-numbered sample points removed. In the illustrated example, these waveform sample data sets WD1, WD2, WD3 have been thinned in such a manner that if the individual thinned waveform sample data sets WD1, WD2, WD3 are reproduced in accordance with predetermined pitch information and at a predetermined output sampling frequency (48 kHz), the reproduced pitches of the thinned waveform sample data WD1, WD2, WD3 will be higher than the pitch of the original waveform sample data WD by one octave, two octaves and three octaves, respectively. Thus, the data quantities of the thinned waveform sample data WD1, WD2, WD3, . . . are ½, ¼, ⅛, . . . of the data quantity of the original waveform sample data WD.

Figure 7A:
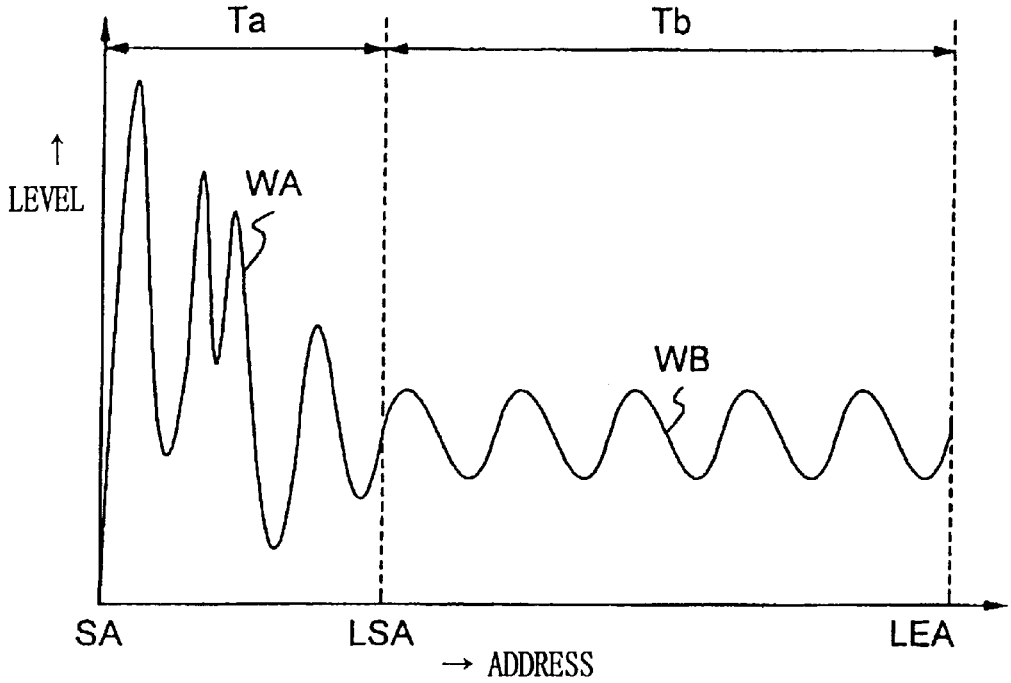
FIGS. 7A and 7B are conceptual diagrams explanatory of loop start and loop start in the second embodiment.

As seen from FIG. 7A, a waveform obtained by actually performing a musical instrument tends to present complicated variations over a given period Ta right after the start of the performance and then present stable variations in a succeeding period Tb. For this reason, when it is desired to reproduce the original waveform sample data WD of same tone color for a long time, the complicated waveform WA for the period Ta is first reproduced followed by reproduction of the stable waveform WB for the period Tb, and then the stable waveform WB for the period Tb is reproduced in repetition. By so doing, it is possible to effectively cut down the total data quantity of the waveform sample data WD. In the following description, the start point of such a stable waveform WB will be called a "loop start" while the end point of the waveform WB will be called a "loop end".

Figure 7B:
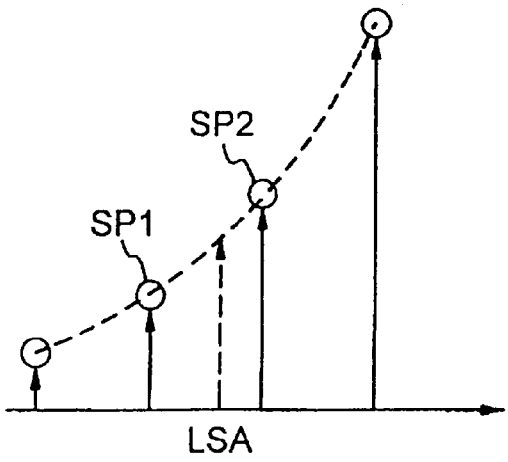
Figure 7C:
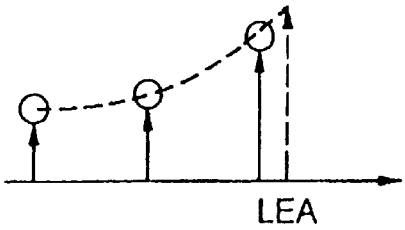

FIG. 7B is a diagram showing an exemplary manner in which the original waveform sample data WD are arranged at and near the loop start. For repetitive reproduction of the waveform WB, it is necessary to smoothly interconnect the loop end and loop start. Thus, in this example, a loop start address LSA and loop end address LEA are preset for the waveform sample data WD as parameters for reproducing the waveform sample data WD so that a looped reproduction is effected smoothly using these parameters. Here, the loop start address LSA and loop end address LEA serve as connecting information to permit a repetitive reproduction of the waveform sample data WD from its end back to its intermediate portion. The loop start address LSA and loop end address LEA are such addresses corresponding to the loop start and loop end and each contain a decimal portion. If, for example, address values at sample points SP1 and SP2 are "10" and "11", the loop start address LSA will be set to "10.6".

Because a plurality of the thinned waveform sample data sets WD1, WD2, WD3, . . . are created on the basis of the original waveform sample data set WD in the illustrated example, it is necessary to set different loop start addresses LSA1, LSA2, LSA3, . . . and loop end addresses LEA1, LEA2, LEA3, . . . for the individual thinned waveform sample data sets WD1, WD2, WD3, . . . . To this end, the device driver DD multiplies the loop start and end addresses LSA and LEA of the original waveform sample data WD by ½, ¼, ⅛, . . . to create loop start addresses LSA1, LSA2, LSA3, . . . and loop end addresses LEA1, LEA2, LEA3, . . . and stores the thus-created loop start and end addresses into the RAM 30 in association with the thinned waveform sample data sets WD1, WD2, WD3, . . . . Each pair of these loop start addresses LSA1, LSA2, LSA3, . . . and loop end addresses LEA1, LEA2, LEA3, . . . serves as connecting information to permit a repetitive reproduction of the corresponding waveform sample data from its loop end back to its loop start.

Because it is sufficient to only multiply the loop start and end addresses LSA and LEA of the original waveform sample data by $1/2^n$ in this case, the loop start addresses LSA1, LSA2, LSA3, . . . and loop end addresses LEA1, LEA2, LEA3, for the thinned waveform sample data sets WD1, WD2, WD3, . . . can be readily created by bit-shifting the loop start and end addresses LSA and LEA. In other words, the thinning rates of ½, ¼, ⅛, . . . of the thinned waveform sample data sets WD1, WD2, WD3, . . . are set in this example such that the loop start addresses LSA1, LSA2, LSA3, . . . and loop end addresses LEA1, LEA2, LEA3, . . . can be calculated with ease.

Referring back to FIG. 5, a tone generator board 100 is attachable into an extension slot (not shown), where there are provided the tone generator LSI 101 for generating to-be-reproduced tone waveform data SD and a DAC (Digital-to-Analog Converter) 37 for converting the to-be-reproduced tone waveform data SD into analog reproduced tone signal S. In this example, the to-be-reproduced tone waveform data SD are collectively reproduced for each predetermined sample group called a "frame"; in this case, one frame is a period of time (5.3 msec.) within which 256 samples of the to-be-reproduced tone waveform data SD are output at the output sampling frequency of 48 kHz. Further, in this example, the tone generator LSI 101 is capable of simultaneously reproducing to-be-reproduced tone waveform data SD of a plurality of different tones (e.g., 64 channels).

To obtain to-be-reproduced tone waveform data for a given frame (256 samples), the tone generator LSI 101 first fetches a predetermined number of the waveform sample data WD, necessary for reproducing 256 samples for the first channel, from the RAM 30 via the PCI bus 60. Specific sort of the waveform sample data sets WD is determined by the tone color information, and the predetermined number of the waveform sample data WD is determined in accordance with the pitch information. The necessary sample fetching is effected via a burst transmission by designating the head address of the specific waveform sample data set WD and the predetermined number of the waveform sample data.

Namely, predetermined successive regions of the designated waveform sample data set WD are extracted from the RAM 30 and collectively transferred to the tone generator LSI 101, which in turn creates 256 samples for the first channel on the basis of the thus-fetched samples. Then, the tone generator LSI 101 creates 256 samples for the second channel in a similar manner and calculates 256 accumulated samples by adding together each pair of the corresponding created samples for the first and second channels. By repeating such operations for a total of 64 channels, the tone generator LSI 101 can ultimately obtain 256 accumulated samples which are the results of summing the corresponding created samples for the 64 channels over a predetermined frame period. Although these operations are executed every frame, the 256 accumulated samples thus generated in a given frame are transferred to the DAC 37 in a next frame in accordance with the sampling frequency. Output buffer 36 for storing the 256 accumulated samples is in the form of a dual buffer structure so that when one of the buffers is being used for accumulative writing of 256 samples, the other buffer can be used for readout of other 256 samples and their functions are alternated every frame.

As seen in FIG. 5, the tone generator LSI 101 includes a control unit 31, PCI bus interface 32, input buffer 33, interpolating section 34, arithmetic operator section 35 and output buffer 36. The control unit 31 stores the microprograms MP, transferred from the RAM 30, into its internal memory (not shown) and issues instructions i for controlling various components of the tone generator LSI 101 in accordance with the microprograms MP. The PCI bus interface 32 has a bus-master function, so that the tone generator LSI 101 is allowed to read out the control data CD, waveform sample data WD, etc. directly from the RAM 30 without intervention of the CPU 70.

The input buffer 33 temporarily stores samples the waveform sample data WD or thinned waveform sample data WD1, WD2, WD3, . . . that is selectively transferred by burst transmission via the PCI bus interface 32; specifically, the input buffer 33 is composed of two buffers 331 and 332 so that when one of the buffers is writing the transferred waveform sample data therein, the other buffer can output the already-written waveform sample data therefrom. Further, the interpolating section 314 carries out an interpolation process on the waveform sample data WD or thinned waveform sample data WD1, WD2, WD3, . . . to provide interpolated waveform sample data WD'. Whereas the pitch-up capability of the tone generator LSI 101 depends on the storage capacities of the input and output buffers 33 and 36, this embodiment chooses the capacities of the input and output buffers 33 and 36 such that they can cope with pitch shifts up to twice as great a frequency range (one octave) as the original.

In the second embodiment, the control unit 31 specifies a particular one of the waveform sample data sets on the basis of the tone color information contained in the control data CD and also specifies a predetermined quantity of the particular waveform sample data to be transferred on the basis of the pitch information also contained in the control data CD. If the tone color information of the control data CD indicates the tone color of violin and the pitch information indicates a 2.3-octave shift-up, then the control unit 31 specifies the thinned waveform sample data set WD2for the violin tone color. In this case, although the pitch information indicates a 2.3-octave shift-up, the thinned waveform sample data WD2 corresponds to a pitch two octaves higher that that of the waveform sample data set WD, and thus, the thinned waveform sample data WD2 is 0.3 octaves short. However, this shortage can be made up for by a pitch shift process including interpolations performed by the tone generator LSI 101.

Namely, when the pitch information of the control data CD indicates a pitch-up relative to the original waveform sample data WD which is beyond the pitch-up capability of the tone generator LSI 101, the control unit 31 sets a smallest possible thinning rate such that the intended pitch-up falls within the pitch-up capability of the tone generator LSI 101. Because the pitch-up capability of the tone generator LSI 101 is one octave in this case, the control unit 31 specifies a particular one of the waveform sample data set WD and thinned waveform sample data sets WD1, WD2, WD3, . . . which corresponds to the integer portion of the pitch information, and it issues an instruction i to the PCI bus interface 32 that the interface 32 should transfer samples of the specified waveform sample data set to the input buffer 33. In this sense, the control unit 31 functions as a data readout section which specifies and reads out samples of one of the thinned waveform sample data sets WD1, WD2, WD3 that are be subjected to the subsequent interpolation.

Thus, when a tone signal S higher in pitch than the original waveform is to be reproduced, it is possible to cut down the quantity of the waveform sample data to be transferred to the input buffer 33 and thereby shorten a time when the bus 60 should be exclusively used by the data transfer. It is also possible to reduce the chip size or storage capacity of the input buffer 33 and expand the frequency range of the to-be-reproduced tone waveform data SD.

The arithmetic operator section 35 executes arithmetic operations to generate to-be-reproduced tone waveform data SD, on the basis of the tone volume information of the control data CD and in accordance with an filtering instruction given from the microprograms MP. The filtering process in this case is intended to impart a delicate tone-color modulation and an acoustic effect such as reverberation or chorus, which allows the tone waveform data SD to be reproduced in a diversified, expressive manner.

Similarly to the above-mentioned input buffer 33, the output buffer 36 is in the form of a dual buffer structure composed of buffers 361 and 362 so that when one of the buffers is being used for accumulative writing of the to-be-reproduced tone waveform data SD, the other buffer can be used for readout of already-written tone waveform data SD. In this case, the to-be-reproduced tone waveform data SD are read out from the output buffer 36 at the output sampling frequency of 48 kHz. The thus read-out to-be-reproduced tone waveform data SD are output from the tone generator board 100 after being converted into analog reproduced tone signal S.

Figure 8:
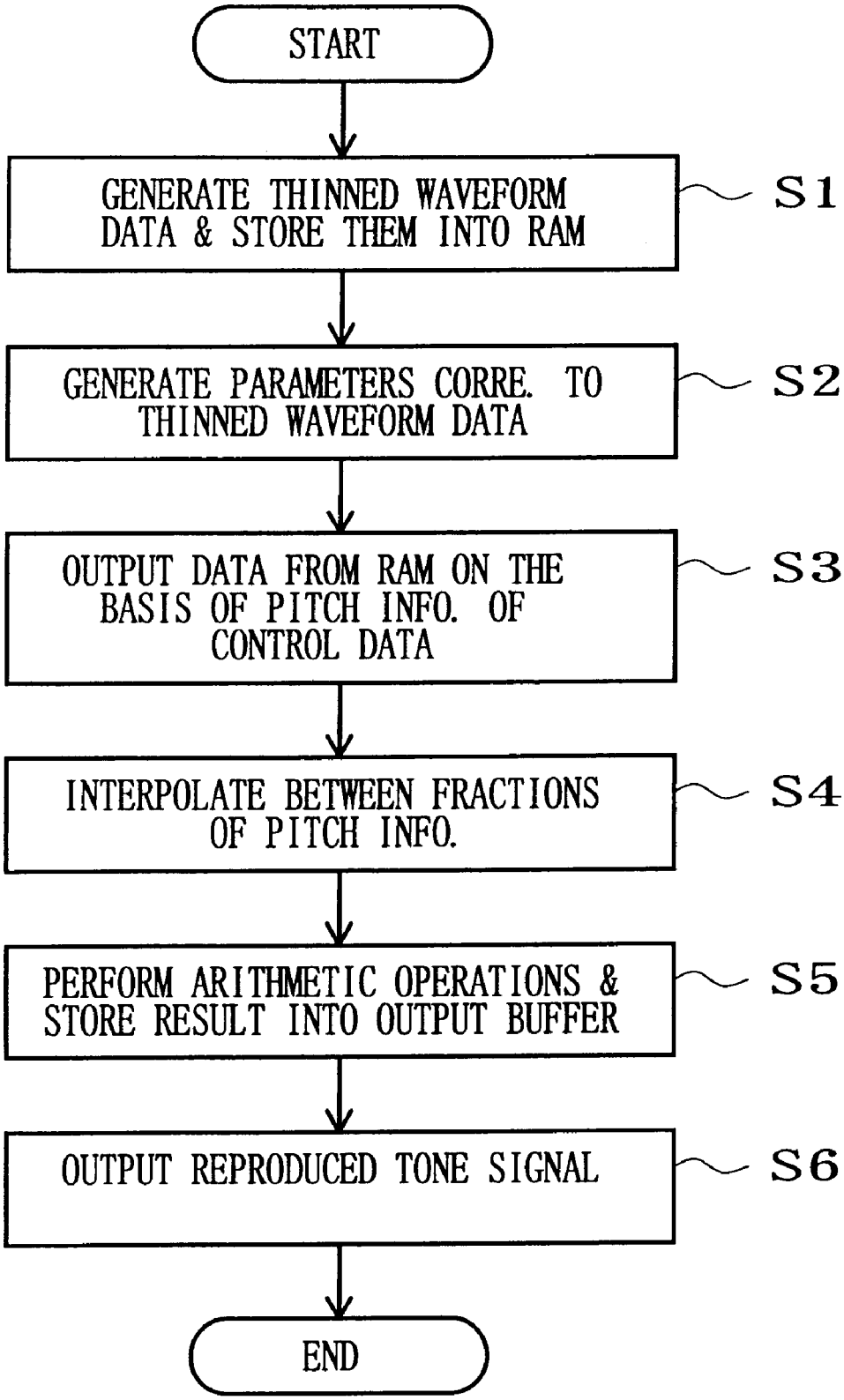
FIG. 8 is a flowchart showing a exemplary step sequence of a tone signal reproducing process in the second embodiment.

Next, a description will be made about a tone signal reproducing process in the computer system COM of the second embodiment. FIG. 8 is a flowchart showing an exemplary step sequence of the tone signal reproducing process.

Figure 9:
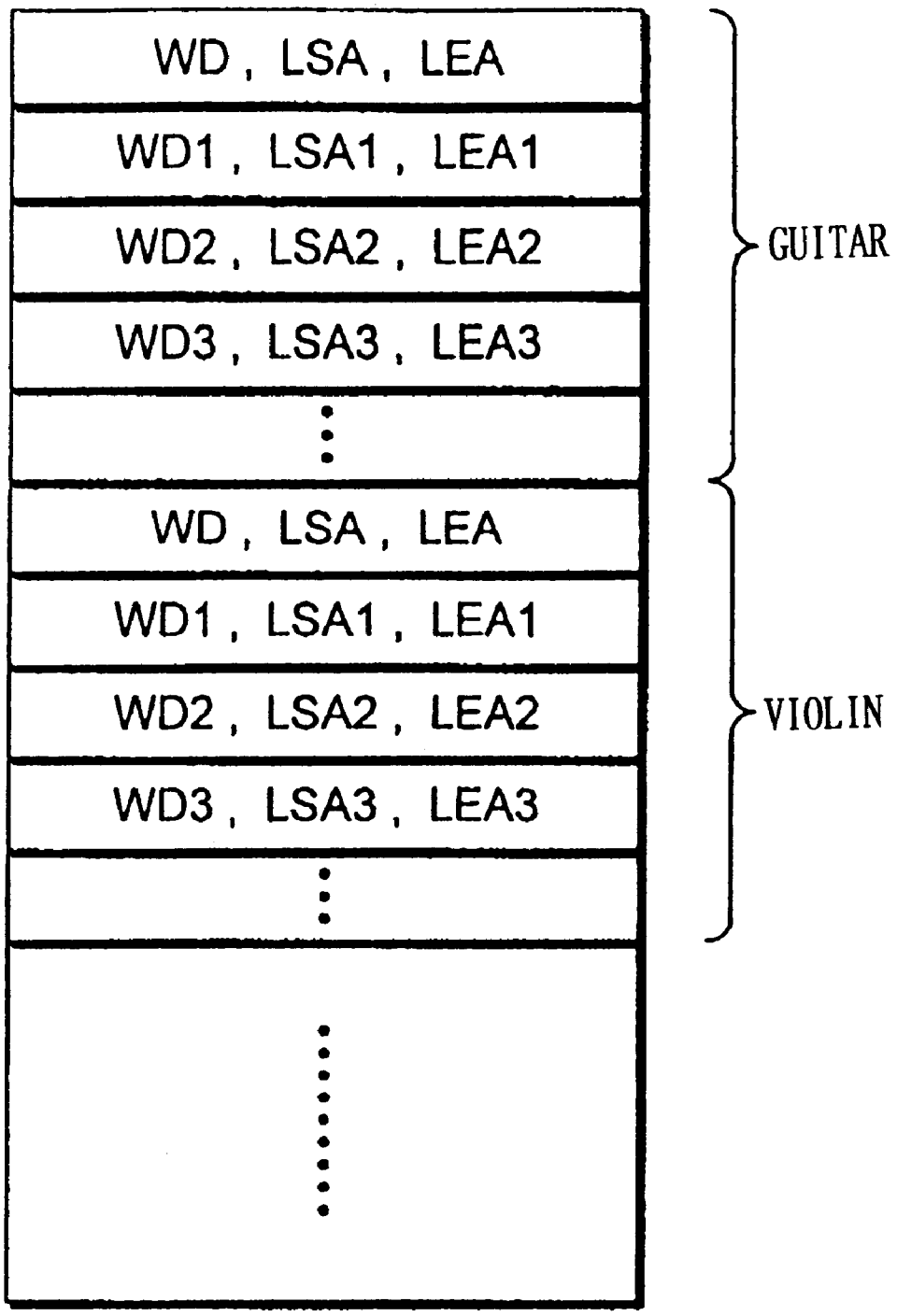
FIG. 9 is a diagram showing exemplary stored contents of a RAM in the second embodiment.

First, at step S1, the device driver DD creates the thinned waveform sample data WD1, WD2, WD3, . . . on the basis of the original waveform sample data WD and stores the thus-created thinned waveform sample into the RAM 30. At next step S2, the device driver DD also creates loop start addresses LSA1, LSA2, LSA3, . . . and loop end addresses LEA1, LEA2, LEA3, . . . on the basis of the loop start and end addresses LSA and LEA of the original waveform sample WD, and stores the thus-created loop start and end addresses into the RAM 30 in association with the thinned waveform sample data WD1, WD2, WD3, . . . . As illustratively shown in FIG. 9, the waveform sample data are stored in the RAM 30 in association with various tone colors such as those of violin and guitar.

When the device driver DD transfers the control data CD to the control unit 31 of the tone generator LSI 101 in response to a tone generation instruction from a higher-order application program, the control unit 31 specifies a particular one of the waveform sample data sets on the basis of the tone color and pitch information of the control data CD. Then, once the control unit 31 designates the particular waveform sample data set to the PCI bus interface 32, the bus interface 32 operates as the bus master to read out the designated waveform sample data from the RAM 30 at step S3. If the tone color information designates the tone color of guitar and the pitch information designates a 1.3-octave pitch-up (corresponding to a frequency two and a half (2.5) times higher than the original pitch), waveform sample data WD1 and its loop start and end addresses LSA1 and LEA1 will be read out from the RAM 30 of FIG. 9. In this case, the number of the waveform sample data WD1 to be transferred will be equal to the number of samples necessary for a 0.3-octave pitch-up process executed within the tone generator LSI 101. Then, as the waveform sample data are read out from the input buffer 33 in accordance with the pitch information, the interpolating section 34 interpolates between the read-out waveform sample data to thereby create interpolated waveform sample data WD' at step S4.

Figure 10:
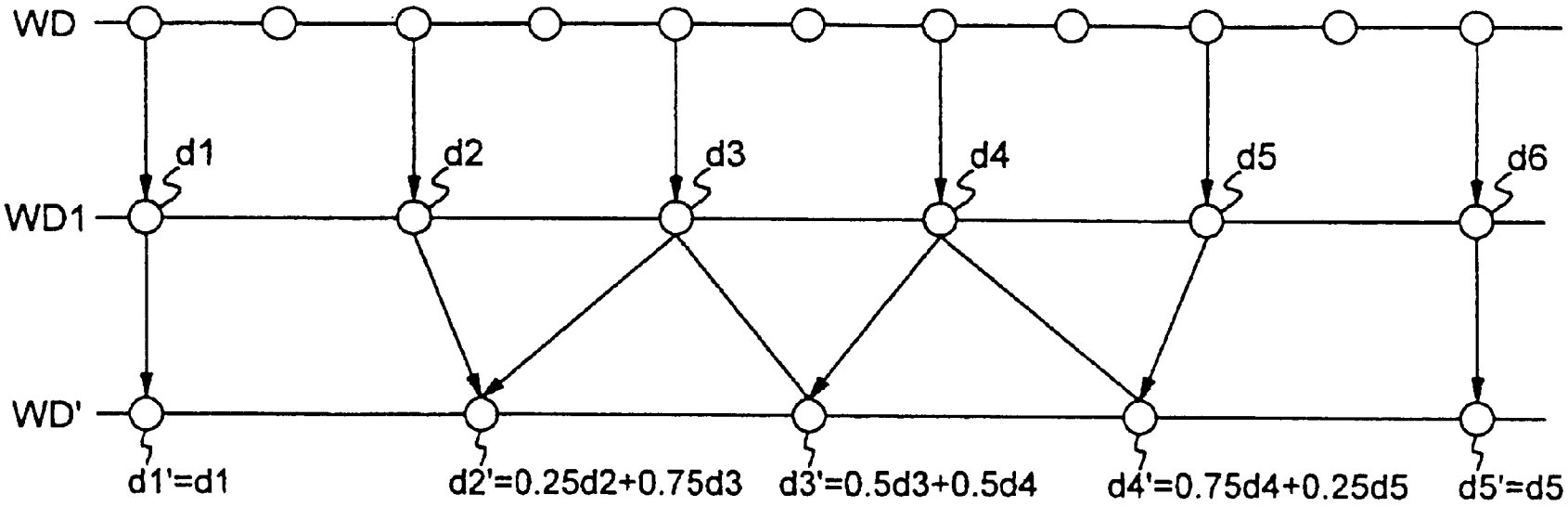
FIG. 10 is a conceptual diagram explanatory of interpolating operations executed in the second embodiment.

FIG. 10 is a conceptual diagram explanatory of the interpolating operations normally executed in the embodiment. In the illustrated example, the thinned waveform sample data WD1, thinned into a half of the total number of the original waveform sample data WD, are stored into the input buffer 33, so that a one-octave pitch-up is achieved by reproducing the thinned waveform sample data WD1 in the same manner as the original or non-thinned waveform sample data. Accordingly, the tone generator LSI 101 will attend to a pitch-up by 0.3 octave. Whereas the 0.3-octave pitch-up, theoretically speaking, may be realized by creating 256 samples to be stored into the output buffer while thinning out the samples in the input buffer, this embodiment is arranged to carry out linear interpolation in order to cut down unwanted aliasing noise. In this case, the interpolating section 34 performs the linear interpolation between two adjoining samples to thereby create interpolated waveform sample data WD'; for example, an interpolated waveform sample d2' is calculated by performing an arithmetic operation of "0.25d2+0.75d3", where the interpolation coefficients 0.25 and 0.75 are calculated on the basis of the pitch information. Normally, as where the input and output sampling frequencies of the waveform sample data WD are equal to each other, the pitch information designating a one-octave pitch-up will take an actual number "2", and the pitch information designating a 1.3-octave pitch-up will take an actual number "2.5". Because a one-octave pitch-up employs the thinned waveform sample data as noted above, the pitch information value "2.5" is modified to "1.5" and the decimal portion of a value obtained by accumulating the modified value "1.5" is used as the interpolation coefficient.

As noted previously, the loop start address LSA and loop end address LEA are chosen so as to permit a smooth connection from the loop end back to the loop start. Because the present embodiment prepares the thinned waveform sample data sets WD1, WD2, . . . by uniformly thinning the original waveform sample data WD, the samples at and near the loop start and end addresses LSA and LEA would not be thinned evenly, so that a smooth loop connection is not necessarily achieved. This inconvenience, however, may be avoided by executing multi-point interpolation, rather than two-point interpolation (linear interpolation), at and near the loop connection.

At step S5 following step S4 of FIG. 8, the arithmetic operator section 35 carries out various arithmetic operations, such as for tone color modulation and tone volume and tonal effect impartment, on the interpolated waveform sample data WD' to generate to-be-reproduced tone waveform data SD and stores the generated to-be-reproduced tone waveform data SD into the output buffer 36 while executing the inter-channel accumulation. Then, as the to-be-reproduced tone waveform data SD are read out from the output buffer 36 at the output sampling frequency, it is converted into analog tone signal S by the DAC 37 at step S6.

With the above-described second embodiment where the thinned waveform sample data sets WD1, WD2, WD3, . . . are created by the device driver DD for storage in the RAM 30 so that any necessary waveform sample data are transferred to the tone generator LSI 101 on the basis of the pitch information, it is possible to expand the frequency range of the to-be-reproduced tone waveform data SD while permitting a reduction of the capacity of the input buffer 33.

In the above-described second embodiment, it is necessary to reserve in the RAM 30 a particular space for storing the thinned waveform sample data WD1, WD2, WD3, . . . , which would undesirably require a greater capacity of the RAM 30. Thus, a third embodiment of the present invention, which will hereinafter be described in detail, is arranged to expand the reproducible frequency range in the tone reproduction process without requiring a increased capacity of the RAM 30.

Figure 11:
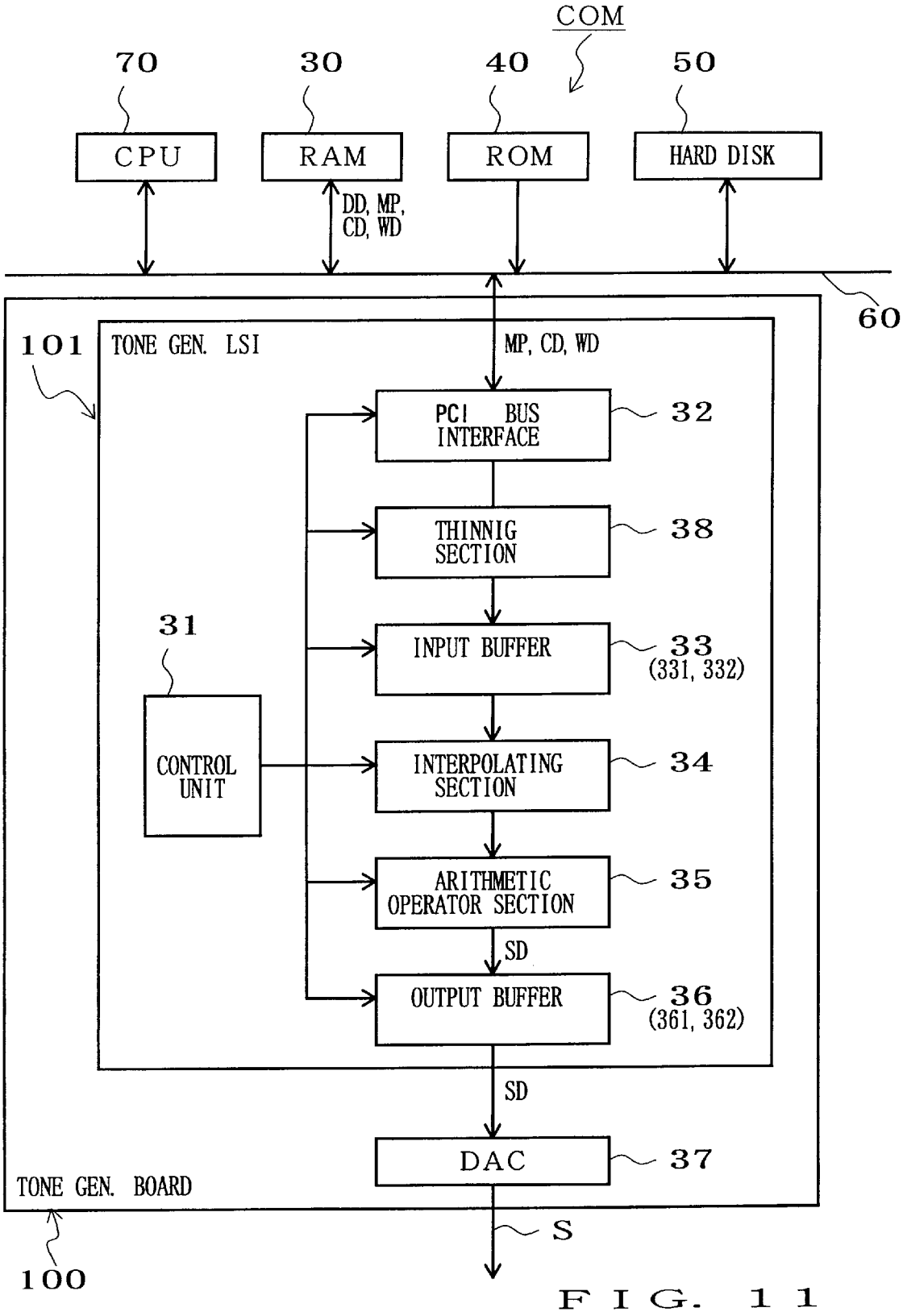
FIG. 11 is a block diagram of a computer system in accordance with a third embodiment of the present invention.

FIG. 11 is a block diagram of a computer system COM2 in accordance with the third embodiment of the present invention, which is similar to the computer system COM of FIG. 5 except that a thinning section 38 is provided between the PCI bus interface 32 and the input buffer 33. The input buffer 33 in this example is provided with a write-enable terminal so that the buffer 33 is placed in a writable state when a write-enable signal WE applied to the terminal is at a High level but is placed in a nonwritable state when the write-enable signal WE is at a Low level. In the third embodiment, the RAM 30 stores only the original waveform sample data WD and does not stores any thinned waveform sample data.

The above-mentioned thinning section 38 includes a table TBL storing various different H/L level patterns of the write-enable signal WE applied to the input buffer 33 which constitute thinning patterns. The thinning section 38 selects one of the thinning patterns and thins the waveform sample data WD in accordance with the selected thinning pattern. Specifically, the thinning section 38 supplies the input buffer 33 with the waveform sample data WD and write-enable signal WE. In the following description, the write-enable signal WE when no data thinning is effected will be denoted by reference character WE0, the write-enable signal WE when data thinning at a rate of ½ relative to the original is effected will be denoted by WE1, and the write-enable signal WE when data thinning to ¼ of the original number of samples is effected will be denoted by reference character WE2.

Figure 12:
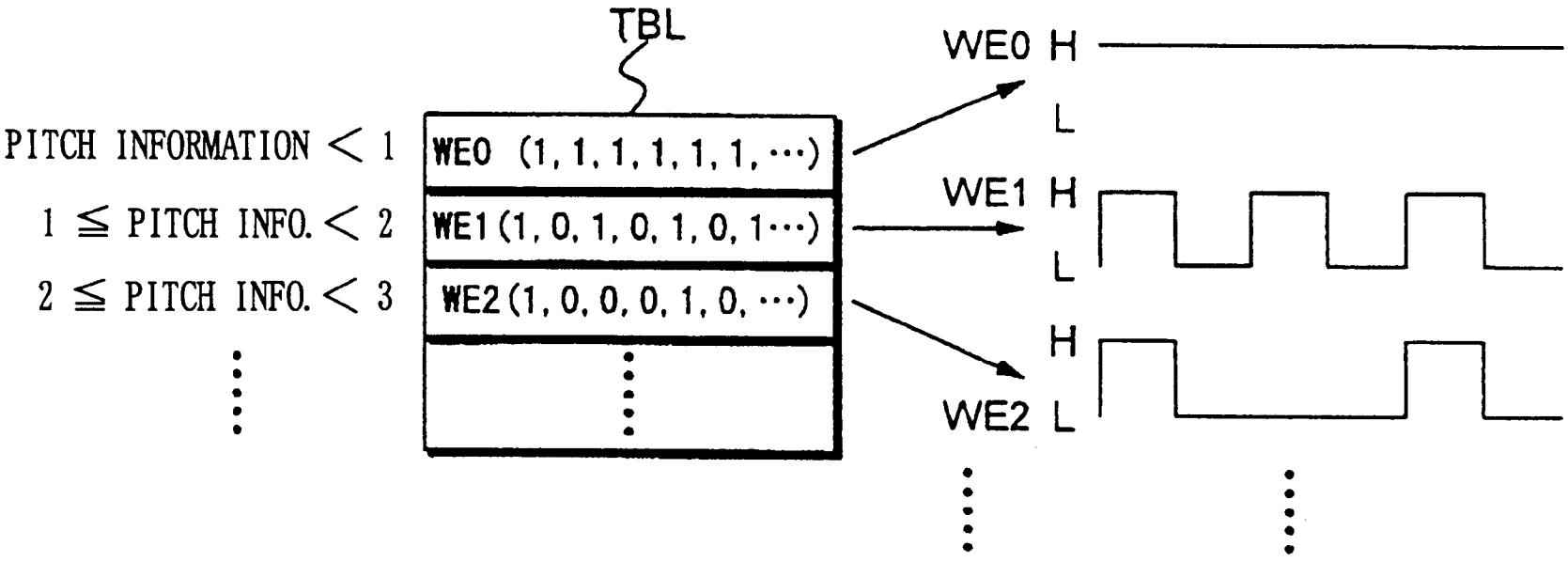
FIG. 12 is a conceptual diagram explanatory of operations for generating a write-enable signal in the third embodiment.

The following paragraphs describe exemplary operations for generating the write-enable signal WE, with reference to FIG. 12. As noted earlier, the buffer 33 is placed in the writable state when the write-enable signal WE applied to the terminal is at a High level but is placed in the nonwritable state when the write-enable signal WE is at a Low level.

In accordance with the integer portion of the pitch information, the thinning section 38 determines which region of the table TBL the write-enable signal WE is to be read out from. Specifically, the write-enable signal WE0 is read out when the desired pitch-up amount is below one octave, the write-enable signal WE1 is read out when the desired pitch-up amount is below two octaves but not smaller than one octave, and the write-enable signal WE1 is read out when the desired pitch-up amount is below three octaves but not smaller than two octaves. The original waveform sample data WD transferred from the RAM 30 are stored into the input buffer 33 while being subjected to necessary thinning based on the write-enable signal WE. For example, when the pitch information designates a 1.3-octave pitch-up, the write-enable signal WE1 is selected, so that the original waveform sample data WD are thinned at the rate of ½ and the resultant thinned waveform sample data WD1 as shown in FIG. 6 are stored into the input buffer 33. Thus, it is only necessary to prestore the waveform sample data WD in the RAM 30, because desired thinned waveform sample data are created by the thinning section 38 as necessary. This arrangement permits a significant reduction of the necessary storage capacity of the RAM 30.

Whereas the above-described second embodiment is arranged to prestore in the RAM 30 the loop start and end addresses of the thinned waveform sample data WD1, WD2, WD3, . . . for the looping purposes, the third embodiment is designed to prestore only the original waveform sample data WD and loop start and end addresses LSA and LEA of the original waveform sample data WD. Thus, the thinning section 38 calculates loop start and end addresses of designated thinned waveform sample data on the basis of the loop start and end addresses LSA and LEA of the original waveform sample data WD which are written in an internal register of the PCI bus interface 32.

Specifically, when, for example, the thinned waveform sample data WD1 are to be stored into the input buffer 33, the loop start and end addresses LSA and LEA of the original waveform sample data WD are read out from the internal register of the PCI bus interface 32 and bit-shifted to provide the loop start and end addresses LSA1 and LEA1 of the thinned waveform sample data WD1 which are then passed to the interpolating section 34. Note that the interpolating section 34, arithmetic operator section 35, output buffer 36 and DAC 37 are of the same construction as the counterparts of the second embodiment and hence will not be described in detail.

Figure 13:
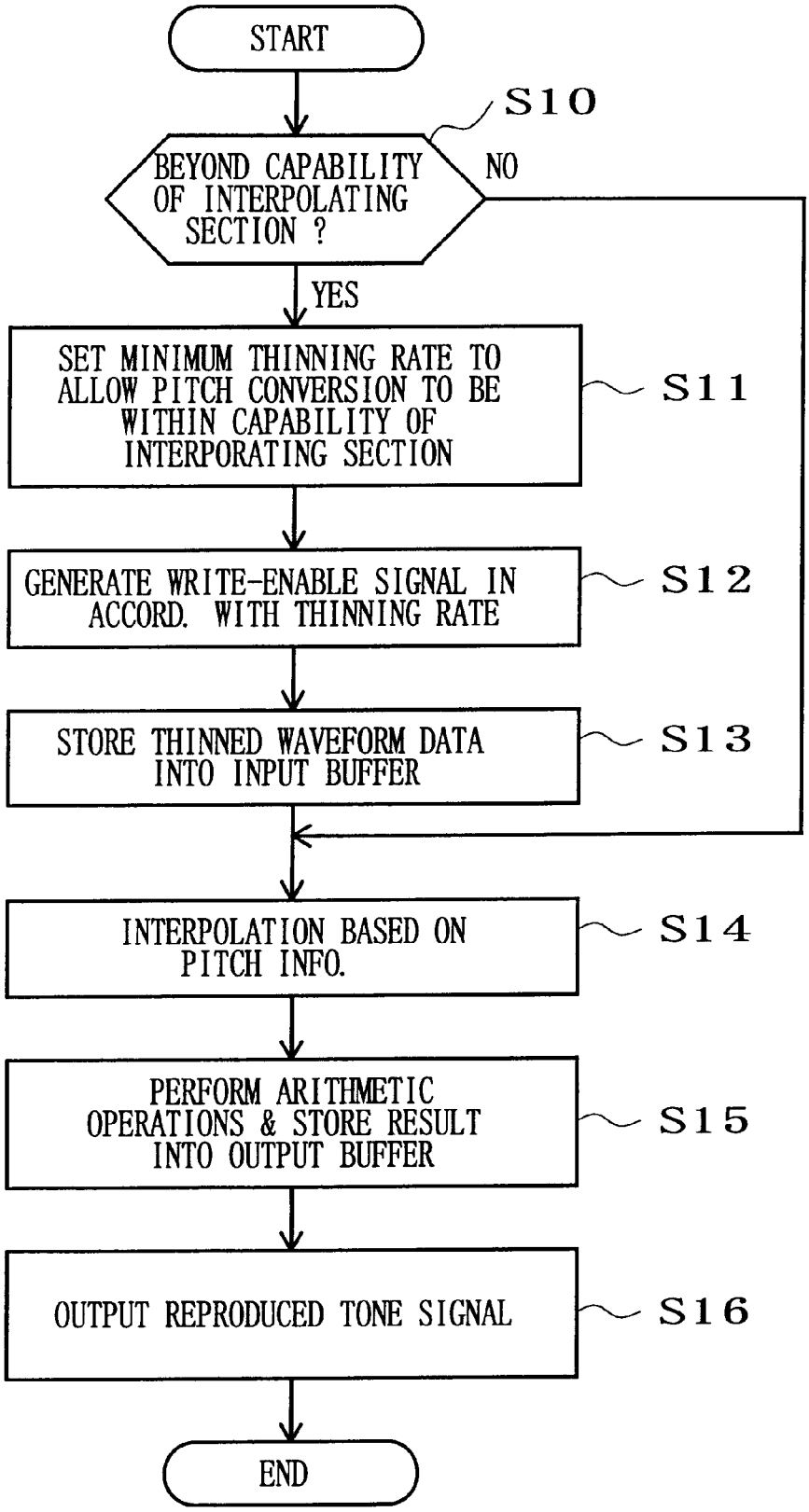
FIG. 13 is a flow chart showing a exemplary step sequence of a tone signal reproducing process in the third embodiment.

Next, a description will be made about a tone signal reproducing process in the computer system COM2 according to the third embodiment. FIG. 13 is a flowchart showing a exemplary step sequence of the tone signal reproducing process and particularly various operations carried out by the tone generator LSI 101.

First, at step S10, the control unit 31 determines whether or not a designated pitch conversion is beyond the pitch-up capability of the tone generator LSI 101. Because the pitch-up capability of the tone generator LSI 101 only can cover up to a one-octave pitch-up, an affirmative (YES) determination is made at step S10 if the pitch information designates a pitch-up amount over one octave. With the affirmative determination, the process moves to step S1, where the control unit 31 sets a smallest possible thinning rate such that the intended pitch-up falls within the pitch-up capability of the tone generator LSI 101. Then, at step S12, the control unit 31 reads out one of the write-enable signal WE from the table TBL in accordance with the thus-set thinning rate. Thus, the original waveform sample data WD are thinned at a predetermined thinning rate and the resultant thinned waveform sample data are stored into the input buffer 33. Consequently, it is not necessary to previously create and store thinned waveform sample data sets WD1, WD2, WD3, . . . in the RAM 30.

Figure 14:
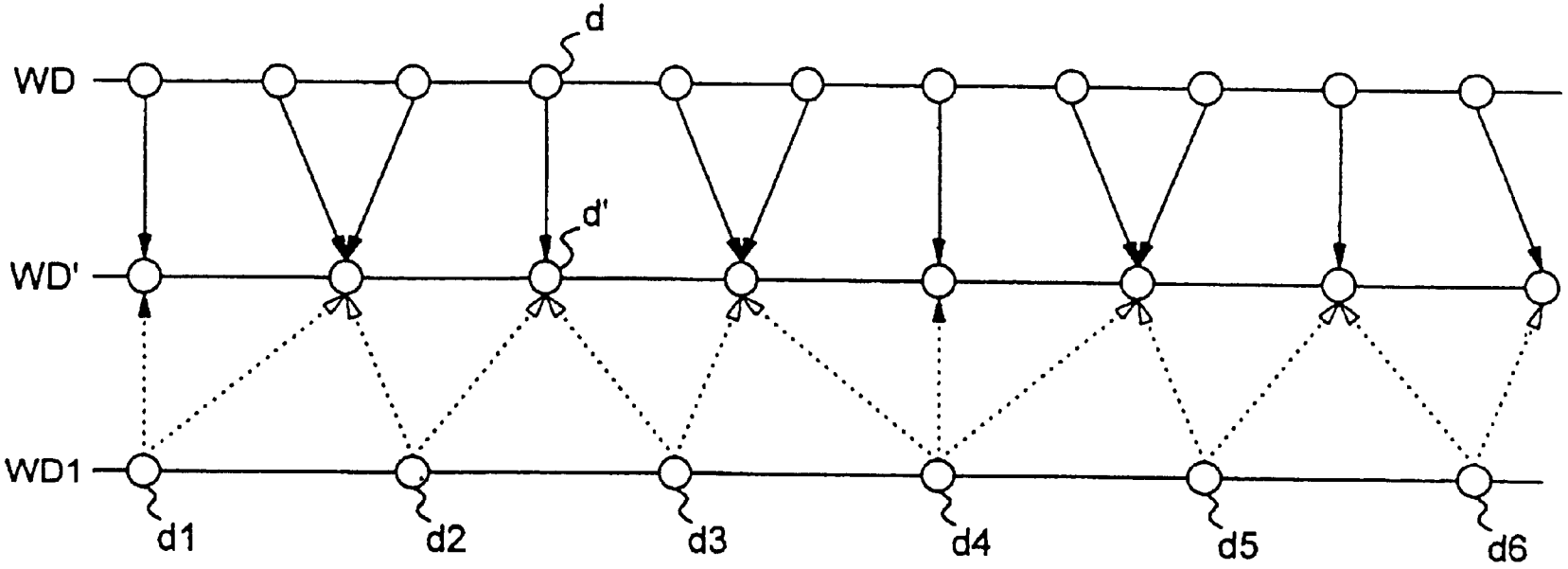
FIG. 14 is a diagram showing an exemplary relationship among original waveform data, thinned waveform data and interpolated waveform data in the third embodiment.

Note that the reason why the control unit 31 sets the smallest possible thinning rate such that the intended pitch-up falls within the pitch-up capability of the tone generator LSI 101 is to cut down unwanted aliasing noise that would be generated by the waveform data thinning. In a situation where the pitch information indicates a 0.6-octave pitch-up (corresponding to a frequency range one and a half times (1.5) as wide as the original), the original waveform sample data WD, thinned waveform sample data WD1 and interpolated waveform sample data WD' present a relationship as shown in FIG. 14. As seen in FIG. 14, each sample of the interpolated waveform sample data WD' is located closer to the corresponding sample of the original waveform sample data WD than that of the thinned waveform sample data WD1. Although the sample d' of the interpolated waveform sample data WD' exactly coincides with the sample d of the original waveform sample data WD, calculating the sample d' from the thinned waveform sample data WD1 would require calculation based on the samples d2 and d3. Such an interpolation based on the data values at remote sample points tends to involve an error, which would increase the aliasing noise. However, the third embodiment can effectively cut down the aliasing noise by setting the smallest possible thinning rate such that the intended pitch-up falls within the pitch-up capability of the tone generator LSI 101.

Figures 15A, 15B, 15C:
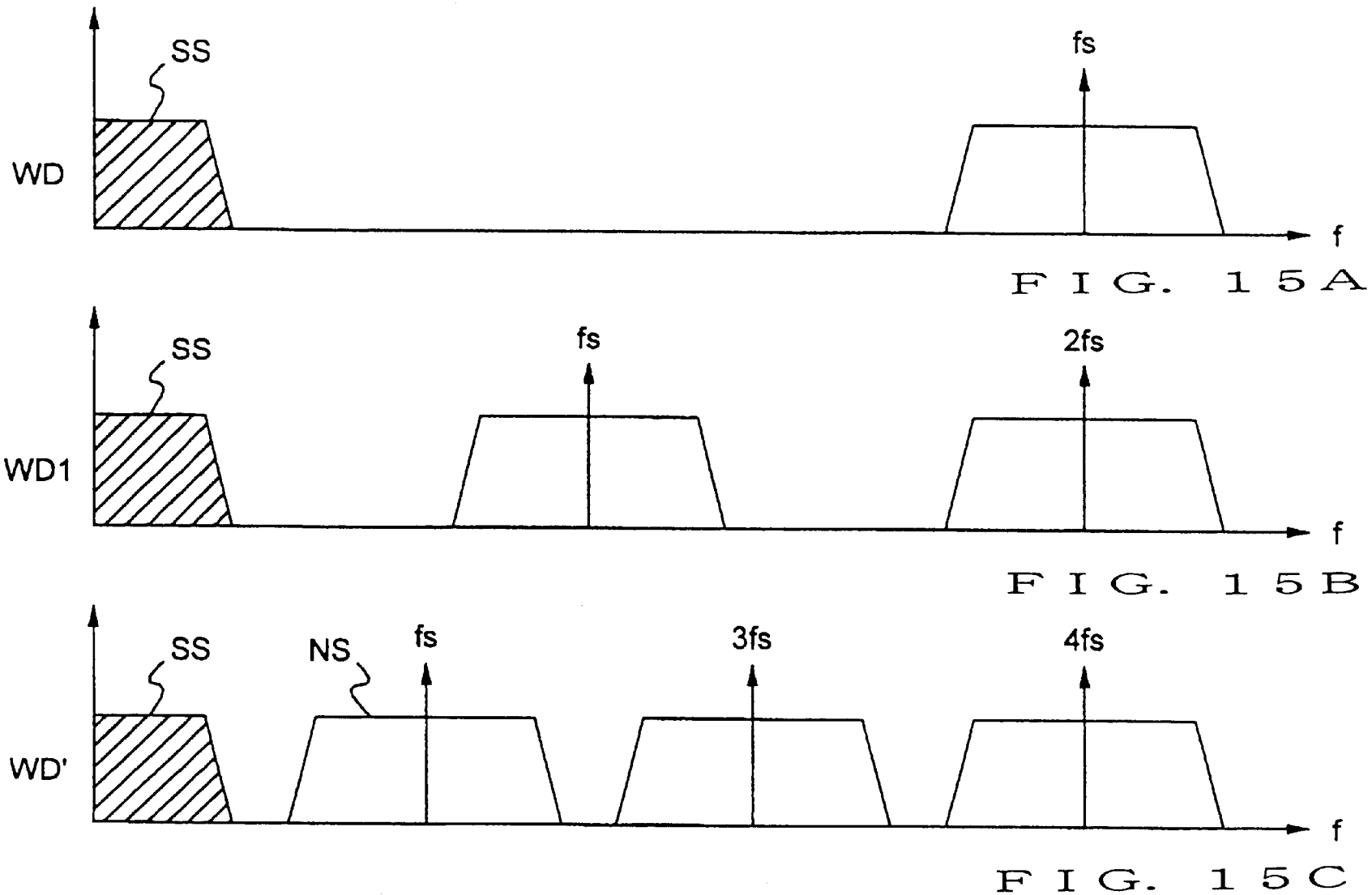
FIGS. 15A to 15C are conceptual diagrams showing an exemplary relationship among the original waveform data, thinned waveform data and interpolated waveform data in the third embodiment.
Figure 16:
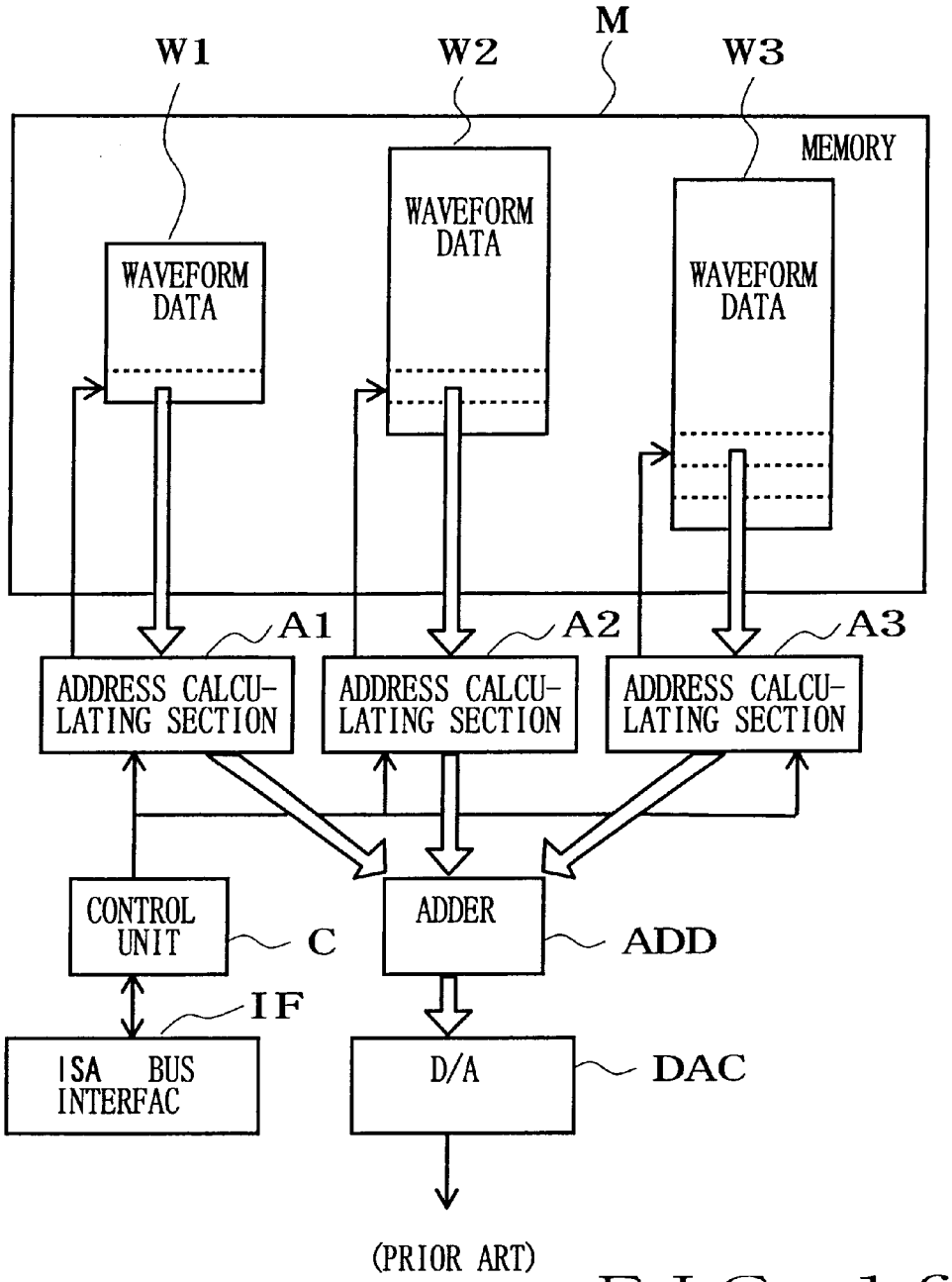
(PRIOR ART) FIG. 16
FIG. 16 is a block diagram illustrating a hardware setup of a conventional tone generator device employing the waveform-memory-based tone generating scheme.

As the pitch information indicates a greater value, the aliasing noise would become greater because the interpolation has to be performed on the basis of the data values at remote sample points. Further, in another situation where the pitch information indicates a 1.3-octave pitch-up, the original waveform sample data WD, thinned waveform sample data WD1 and interpolated waveform sample data WD' present a relationship as shown in FIGS. 15A to 15C, where hatched blocks represent signal components SS. In this case, the signal component SS of the interpolated waveform sample data WD' is close to an aliasing component NS of the data WD', and it is likely that the aliasing component NS will pass through an output filter of the DAC 37 and deteriorate the S/N ratio of the tone signal S. In practice, however, with tone colors for which common waveform sample data WD are used over a relatively wide range, the frequencies of the signal component SS of the waveform sample data WD are set to be sufficiently apart from a sampling frequency fs. With this arrangement, the S/N ratio of the tone signal S would not be substantially deteriorated by the aliasing component NS of the interpolated waveform sample data WD' and hence would not present practical problems.

Referring back to FIG. 13, if the designated pitch conversion is within the pitch-up capability of the tone generator LSI 101, a negative determination is made at step S10, in which case the High-level write-enable signal WE is always selected (see the signal WEO of FIG. 12) so that the original waveform sample data WD are stored into the input buffer 33 with no particular modification.

Once the original waveform sample data WD or thinned waveform sample data are stored in the input buffer 33 in the above-mentioned manner, the interpolating section 34 carries out the interpolation on the basis of the pitch information at step S14 in generally the same manner as in the first embodiment. After that, the arithmetic operator section 35, at step S15, stores the to-be-reproduced tone waveform data SD into the output buffer 36 while performing inter-channel accumulation of the data SD. At step S16, The output buffer 36 then outputs the buffered to-be-reproduced tone waveform data SD to the DAC 37, which converts the data into analog tone signal S to be actually audibly reproduced.

With the above-described arrangement that the original waveform sample data WD are thinned on the basis of the pitch information when they are being read out from the RAM 30, the third embodiment can eliminate the need to previously create and store thinned waveform sample data sets. As a result, the the third embodiment is allowed to expand the reproducible frequency range of the to-be-reproduced tone waveform data SD while permitting a significant reduction of the necessary storage capacity of the RAM 30.

Whereas the present invention has been described above in relation to the preferred embodiments, the invention should not be construed as limited to the embodiments, and various modifications of the invention are also possible as set forth below.

While the second and third embodiments have been described above in relation to the case where the maximum pitch-up amount affordable by the tone generator LSI 101 is one octave, the tone generator LSI 101 may be arranged to have a higher pitch-up capability to address a greater pitch-up amount of two octaves. In such a case, it is sufficient that thinned waveform sample data sets, such as the waveform sample data sets WD1, WD2, WD3, . . . , be prestored in the RAM 30 (as proposed in the first embodiment) or that the original waveform sample data be thinned at the time of their transfer (as proposed in the third embodiment).

Further, whereas the interpolating section 13 has been described as performing a linear interpolation based on two sample data, the present invention is not so limited. The interpolated waveform sample data WD' may be created by multiplying three or more sample data by respective weighting coefficients and adding together the thus-weighted sample data. In this case, the interpolated waveform sample data WD' can be created with less errors, which would enhance the quality of the to-be-reproduced tone waveform data SD.

Furthermore, whereas the embodiments have been described above in relation to the case where the waveform sample data WD1, WD2, WD3, . . . are created by thinning the original waveform sample data WD at the thinning rate of $1/2^n$, the present invention is not so limited and any other suitable thinning rates may be chosen. Particularly, where the original waveform sample data WD are to be thinned at the time of their transfer as in the third embodiment, level patterns of the write-enable signal WE may be prestored in the table TBL in association with various possible values of the pitch information, in which case waveform sample data close to sample points of the interpolated waveform sample data WD' can be stored into the input buffer 33. For example, in a situation where a repetitive level pattern of "1, 0, 1, 1, 0" is prestored in the table TBL and the pitch information designates a 1.3-octave pitch-up, a write-enable signal WE is generated by reading out the pattern so as to selectively store only necessary sample data into the input buffer 13.

In addition, in each of the above-described embodiments, the time length of each frame may be modified to be variable, rather than being fixed. Further, whereas the embodiments has been described in relation to the case where the data size or quantity in the transfer block is variable while the data quantity in the output block is constant, the present invention may be modified in such a manner that the data quantity in the transfer block is constant while the data quantity in the output block is variable.

In summary, the present invention arranged in the above-mentioned manner can expand the reproducible frequency range of to-be-reproduced tone waveform data while permitting a significant reduction of the necessary storage capacity of a first buffer memory. Further, because the thinning section thins original waveform sample data in accordance with pitch information and thereby eliminates the need to prestore thinned waveform sample data in a storage device, the present invention can effectively cut down a necessary capacity of the storage device.

What is claimed is:

1. A tone generator device for generating tone waveform data on the basis of waveform sample data stored in a storage device provided separately from the tone generator device, said tone generator device comprising:

an input section that receives a block containing a specific quantity of the waveform sample data collectively transferred from said storage device, wherein said input section, in accordance with pitch information, determines the specific quantity of the waveform sample data to be received thereby in the block and requests said storage device to collectively transfer thereto said quantity of the waveform sample data;

a temporary storage section that temporarily stores therein the waveform sample data collectively transferred from said storage device and received by said input section; and a tone waveform data generator connected to said temporary storage section, wherein said tone waveform generator reads out the waveform sample data from said temporary storage section in accordance with pitch information and generates tone waveform data corresponding to the pitch information on the basis of the waveform sample data read out from said temporary storage section.

2. A tone generator device as recited in claim 1 wherein said input section calculates a specific number of the waveform sample data necessary for generating tone waveform data at a pitch corresponding to the pitch information within a predetermined time range and determines, in accordance with the calculated specific number of the waveform sample data, the specific quantity of the waveform sample to be received thereby in the block.

3. A tone generator device as recited in claim 1 wherein said storage device is managed by a computer and said tone generator device is connected to a bus of the computer.

4. A tone generator device as recited in claim 1 wherein said storage device is managed by a computer that has an extended bus capable of burst transmission, and wherein said input section has an interface for connection to the extended bus of the computer, said input section being connected to said storage device via the interface and the extended bus.

5. A tone generator device as recited in claim 1 wherein said tone waveform data generator reads out the waveform sample data from said temporary storage section at a rate corresponding to the pitch information and executes interpolating arithmetic operations between a plurality of the read-out waveform sample data.

6. A tone generator device for generating tone waveform data on the basis of waveform sample data stored in a storage device provided separately from the tone generator device, said tone generator device comprising:

an input section that receives a block containing a specific quantity of the waveform sample data collectively transferred from said storage device;

a temporary storage section that temporarily stores therein the waveform sample data collectively transferred from said storage device and received by said input section; and a tone waveform data generator connected to said temporary storage section, wherein said tone waveform data generator reads out the waveform sample data from said temporary storage section at a rate corresponding to the pitch information within a short period of time asynchronously with a predetermined reproduction sampling cycle and generates a necessary number of tone waveform data corresponding to the pitch information on the basis of the read-out waveform sample data, and wherein said tone waveform data generator temporarily stores the generated tone waveform data into an output buffer and then sequentially reads out each of the tone waveform data from the output buffer in the predetermined reproduction sampling cycle.

7. A tone generator device as recited in claim 6 wherein said tone waveform data generator executes the interpolating arithmetic operations when said tone waveform data generator generates the necessary number of tone waveform data corresponding to the pitch information on the basis of the read-out waveform sample data.

8. A tone generator device for generating tone waveform data on the basis of waveform sample data stored in a storage device provided separately from the tone generator device, said tone generator device comprising:

an input section that receives a block containing a specific quantity of the waveform sample data collectively transferred from said storage device, wherein said storage device has stored therein control data necessary for reading out the waveform sample data therefrom and said input section includes a control unit that reads out the control data from said storage device and, on the basis of the control data, designates a particular block containing the specific quantity of the waveform sample data to be collectively transferred from said storage device, and wherein said input section issues a request that the block of the waveform sample data designated by said control unit should be read out and collectively transferred from said storage device and receives said block of the waveform sample data collectively transferred in response to said request;

a temporary storage section that temporarily stores therein the waveform sample data collectively transferred from said storage device and received by said input section; and a tone waveform data generator connected to said temporary storage section, wherein said tone waveform data generator reads out the waveform sample data from said temporary storage section in accordance with pitch information and generates tone waveform data corresponding to the pitch information on the basis of the waveform sample data read out from said temporary storage section.

9. A tone generator device as recited in claim 8 which further comprises a control data generator connected to said storage device, wherein on the basis of the control data having been used for reading out the waveform sample data of a given block, generates further control data to be used for reading out the waveform sample data of a next block.

10. A tone generator device as recited in claim 9 wherein the further control data for the next block generated by said control data generator is transferred to said storage device for storage therein, and said control unit retrieves the further control data from said storage device when the further control data is required for reading out the waveform sample data of the next block.

11. A tone generator device connectable to an extended bus of a computer, the computer including a storage device connected to the extended bus, the storage device having stored therein waveform sample data, said tone generator device comprising:

a control unit that designates a block containing a specific quantity of the waveform sample data and requests that the designated block of the waveform sample data should be read out from said storage device and burst-transmitted to said tone generator device via the extended bus, wherein said control unit requests, separately for each of a plurality of channels, a burst transmission of the waveform sample data to be used in the channel;

a temporary storage section that temporarily stores therein the waveform sample data burst-transmitted via the extended bus; and a tone waveform data generator connected to said temporary storage section, wherein said tone waveform data generator, for each of the channels, executes a first process of reading out the waveform sample data from said temporary storage section at a rate corresponding to the pitch information within a short period of time asynchronously with a predetermined reproduction sampling cycle and generates the tone waveform data corresponding to the pitch information on the basis of the read-out waveform sample data, and a second process of adding together the tone waveform data of the channels generated by said first process; and which further comprises an output buffer for temporarily storing therein the tone waveform data added by said second process, each of the tone waveform data temporarily stored in said output buffer being sequentially read out in the predetermined reproduction sampling cycle.

12. A tone generator device as recited in claim 11 wherein said output buffer comprises a pair of buffers whose read/write modes are alternated in such a manner that when the tone waveform data is being read from one of the buffers, the tone waveform data added by said second process is written into another of the buffers.

13. A tone generator device connectable to an extended bus of a computer, the computer including a storage device connected to the extended bus, the storage device having stored therein waveform sample data, said tone generator device comprising:

a control unit that designates a block containing a specific quantity of the waveform sample data and requests that the designated block of the waveform sample data should be read out from said storage device and burst-transmitted to said tone generator device via the extended bus, wherein said control unit, in accordance with pitch information, determines the specific quantity of the waveform sample data to be received in the block;

a temporary storage section that temporarily stores therein the waveform sample data burst-transmitted via the extended bus; and a tone waveform data generator connected to said temporary storage section, wherein said tone waveform data generator reads out the waveform sample data from said temporary storage section in accordance with pitch information and generates tone waveform data corresponding to the pitch information on the basis of the waveform sample data read out from said temporary storage section.

14. A tone generator device connectable to an extended bus of a computer, the computer including a storage device connected to the extended bus, the storage device having stored therein waveform sample data, said tone generator device comprising:

a control unit that designates a block containing a specific quantity of the waveform sample data and requests that the designated block of the waveform sample data should be read out from said storage device and burst-transmitted to said tone generator device via the extended bus;

a temporary storage section that temporarily stores therein the waveform sample data burst-transmitted via the extended bus; and a tone waveform data generator connected to said temporary storage section, wherein said tone waveform data generator reads out the waveform sample data from said temporary storage section in accordance with pitch information and generates tone waveform data corresponding to the pitch information on the basis of the waveform sample data read out from said temporary storage section, wherein said tone waveform data generator reads out the waveform sample data from said temporary storage section at a rate corresponding to the pitch information within a short period of time asynchronously with a predetermined reproduction sampling cycle and generates a necessary number of tone waveform data corresponding to the pitch information on the basis of the read-out waveform sample data, and wherein said tone waveform data generator temporarily stores the generated tone waveform data into an output buffer and then sequentially reads out each of the tone waveform data from the output buffer in the predetermined reproduction sampling cycle.

15. A tone generator device connectable to an extended bus of a computer, the computer including a storage device connected to the extended bus, the storage device having stored therein waveform sample data, said tone generator device comprising:

a control unit that designates a block containing a specific quantity of the waveform sample data and requests that the designated block of the waveform sample data should be read out from said storage device and burst-transmitted to said tone generator device via the extended bus, wherein said storage device has stored therein predetermined original waveform sample data and thinned waveform sample data obtained by thinning the original waveform sample data, and wherein said control unit, in accordance with pitch information, selects the original waveform sample data or the thinned waveform sample data and determines the specific quantity of the selected waveform sample data to be received in the block, whereby the block containing the specific quantity of the selected waveform sample data is read out from said storage device and burst-transmitted via the extended bus to said tone generator device;

a temporary storage section that temporarily stores therein the waveform sample data burst-transmitted via the extended bus; and a tone waveform data generator connected to said temporary storage section, wherein said tone waveform data generator reads out the waveform sample data from said temporary storage section in accordance with pitch information and generates tone waveform data corresponding to the pitch information on the basis of the waveform sample data read out from said temporary storage section.

16. A tone generator device connectable to an extended bus of a computer, the computer including a storage device connected to the extended bus, the storage device having stored therein waveform sample data, said tone generator device comprising:

a control unit that designates a block containing a specific quantity of the waveform sample data and requests that the designated block of the waveform sample data should be read out from said storage device and burst-transmitted to said tone generator device via the extended bus;

a temporary storage section that temporarily stores therein the waveform sample data burst-transmitted via the extended bus, wherein said storage device has stored therein predetermined original waveform sample data and which further comprises a thinning section that, in accordance with the pitch information, thins the original waveform sample data burst-transmitted via the extended bus to thereby generate thinned waveform sample data, the thinned waveform sample data being temporarily stored into said temporary storage section; and a tone waveform data generator connected to said temporary storage section, wherein said tone waveform data generator reads out the waveform sample data from said temporary storage section in accordance with pitch information and generates tone waveform data corresponding to the pitch information on the basis of the waveform sample data read out from said temporary storage section.

17. A tone waveform data processing device for generating tone waveform data on the basis of predetermined original waveform sample data and thinned waveform sample data stored in an external storage device, the thinned waveform sample data being obtained by thinning the original waveform sample data in accordance with a predetermined thinning scheme, said tone waveform data processing device comprising:

a first readout section that, on the basis of pitch information indicative of a particular reproducing pitch, reads out the original waveform sample data or the thinned waveform sample data from said external storage device;

an input buffer section that stores therein the waveform sample data read out from said external storage device by said first readout section;

a second readout section that, on the basis of the pitch information, reads out the waveform sample data from said input buffer section; and a tone waveform data generating section that generates tone waveform data on the basis of the waveform sample data read out from said input buffer section by said second readout section.

18. A tone waveform data processing device as recited in claim 17 wherein said tone waveform data generating section collectively generates a specific number of the tone waveform data, to be output at a predetermined rate within a predetermined unit time, asynchronously with the predetermined rate, and which further comprises an output buffer section that stores therein the specific number of the tone waveform data collectively generated by said tone waveform data generating section, and a third readout section that reads out the tone waveform data from said output buffer section at the predetermined rate.

19. A tone waveform data processing device as recited in claim 18 wherein said first readout section collectively reads out the waveform sample data stored at successive locations of said external storage device used for collectively generating the tone waveform data within the predetermined unit time.

20. A tone waveform data processing device as recited in claim 19 wherein said first readout section determines a specific number of the waveform sample data to be collectively read out from said external storage device, on the basis of the pitch information and storage capacities of said input buffer section and said output buffer section.

21. A tone waveform data processing device as recited in claim 17 wherein said first readout section reads out the original waveform sample data from said external storage device when the pitch information is indicative of a relatively low pitch and reads out the thinned waveform sample data from said external storage device when the pitch information is indicative of a relatively high pitch.

22. A tone waveform data processing device as recited in claim 17 wherein said second readout reads out a plurality of the waveform sample data from said input buffer section on the basis of the pitch information, and wherein said tone waveform data generating section generates the tone waveform data by executing interpolating arithmetic operations between the plurality of the waveform sample data read out by said second readout section.

23. A tone waveform data processing device as recited in claim 17 wherein said external storage device has stored therein, in addition to the original waveform sample data and the thinned waveform sample data, loop reproduction information corresponding to the original waveform sample data and the thinned waveform sample data, and wherein said first readout section reads out the waveform sample data and the loop reproduction information corresponding thereto, and said tone waveform data generating section generates the tone waveform data by reproducing the waveform sample data in a looped manner in accordance with the loop reproduction information.

24. A tone waveform data processing device comprising:

a storage device having stored therein predetermined original waveform sample data and thinned waveform sample data obtained by thinning the original waveform sample data in accordance with a predetermined thinning scheme;

a first readout section that, on the basis of pitch information indicative of a particular reproducing pitch, reads out the original waveform sample data or the thinned waveform sample data from said storage device;

an input buffer section that stores therein the waveform sample data read out from said storage device by said first readout section;

a second readout section that, on the basis of the pitch information, reads out the waveform sample data from said input buffer section; and a tone waveform data generating section that generates tone waveform data on the basis of the waveform sample data read out from said input buffer section by said second readout section.

25. A computer system for implementing said tone waveform data processing device as recited in claim 24 which includes said storage device as a main memory thereof, and a CPU that, via predetermined software, generates the thinned waveform sample data by thinning the original waveform sample data and stores the generated thinned waveform sample data into said storage device.

26. A tone waveform data processing device for generating tone waveform data on the basis of predetermined waveform sample data stored in an external storage device, said tone waveform data processing device comprising:

a first readout section that reads out the waveform sample data from said external storage device;

a thinning section that, on the basis of pitch information indicative of a particular reproducing pitch, thins the waveform sample data read out from said external storage device by said first readout section, to thereby generate thinned waveform sample data;

an input buffer section that stores therein the thinned waveform sample data generated by said thinning section;

a second readout section that, on the basis of the pitch information, reads out the waveform sample data from said input buffer section; and a tone waveform data generating section that generates tone waveform data on the basis of the waveform sample data read out from said input buffer section by said second readout section.

27. A tone waveform data processing device as recited in claim 26 wherein said tone waveform data generating section collectively generates a specific number of the tone waveform data, to be output at a predetermined rate within a predetermined unit time, asynchronously with the predetermined rate, and which further comprises an output buffer section that stores therein the specific number of the tone waveform data collectively generated by said tone waveform data generating section, and a third readout section that reads out the tone waveform data from said output buffer section at the predetermined rate.

28. A tone waveform data processing device as recited in claim 27 wherein said first readout section collectively reads out the waveform sample data stored at successive locations of said external storage device use d f or collectively generating the tone waveform data within the predetermined unit time.

29. A tone waveform data processing device as recited in claim 28 wherein said first readout section determines a specific number of the waveform sample data to be collectively read out from said external storage device, on the basis of the pitch information and storage capacities of said input buffer section and said output buffer section.

30. A tone waveform data processing device as recited in claim 26 wherein said thinning section sets a thinning rate for thinning the waveform sample data, on the basis of the pitch information.

31. A tone waveform data processing device as recited in claim 30 wherein said external storage device has stored therein, in addition to the predetermined waveform sample data, loop reproduction information corresponding to the waveform sample data, and wherein said first readout section reads out the waveform sample data and the loop reproduction information corresponding thereto, said thinning section converts the loop reproduction information in accordance with the thinning rate to thereby generate converted loop information, and said tone waveform data generating section generates the tone waveform data by reproducing the waveform sample data in a looped manner in accordance with the converted loop reproduction information.

32. A tone waveform data processing device as recited in claim 26 wherein said second readout section reads out a plurality of the waveform sample data from said input buffer section on the basis of the pitch information, and wherein said tone waveform data generating section generates the tone waveform data by executing interpolating arithmetic operations between the plurality of the waveform sample data read out by said second readout section.

33. A tone waveform data processing device comprising:

a storage device having stored therein predetermined waveform sample data;

a first readout section that reads out the waveform sample data from said storage device;

a thinning section that, on the basis of pitch information indicative of a particular reproducing pitch, thins the waveform sample data read out from said storage device by said first readout section, to thereby generate thinned waveform sample data;

an input buffer section that stores therein the thinned waveform sample data generated by said thinning section;

a second readout section that, on the basis of the pitch information, reads out the waveform sample data from said input buffer section; and a tone waveform data generating section that generates tone waveform data on the basis of the waveform sample data read out from said input buffer section by said second readout section.

34. A computer system for implementing said tone waveform data processing device as recited in claim 33 which includes said storage device as a main memory thereof.

35. A tone generator device for generating tone waveform data on the basis of waveform sample data stored in a storage device provided separately from the tone generator device, said storage device having stored therein predetermined original waveform sample data and thinned waveform sample data obtained by thinning the original waveform sample data, said tone generator device comprising:

a control unit that, in accordance with pitch information, selects the original waveform sample data or the thinned waveform sample data and determines a specific quantity of the waveform sample data to be contained in a block of the waveform sample data;

an input section that receives said block containing the specific quantity of the waveform sample data collectively transferred from said storage device;

a temporary storage section that temporarily stores therein the waveform sample data collectively transferred from said storage device and received by said input section; and a tone waveform data generating section that reads out the waveform sample data from said temporary storage section in accordance with the pitch information and generates tone waveform data corresponding to the pitch information on the basis of the waveform sample data read out from said temporary storage section.

36. A tone generator device for generating tone waveform data on the basis of predetermined original waveform sample data stored in a storage device provided separately from the tone generator device, said tone generator device comprising:

an input section that receives a block containing a specific quantity of the original waveform sample data collectively transferred from said storage device;

a thinning section that, in accordance with pitch information, thins the original waveform sample data collectively transferred from said storage device to thereby generate thinned waveform sample data;

a temporary storage section that temporarily stores therein the original waveform sample data or the thinned waveform sample data collectively transferred from said storage device and received by said input section; and a tone waveform data generating section that reads out the waveform sample data from said temporary storage section in accordance with the pitch information and generates tone waveform data corresponding to the pitch information on the basis of the waveform sample data read out from said temporary storage section.

37. A method of generating tone waveform data on the basis of waveform sample data stored in a storage device, said method comprising the steps of:

determining, in accordance with pitch information, a specific quantity of the waveform sample data to be received;

requesting said storage device to collectively transfer said specific quantity of the waveform sample data;

receiving a block containing said specific quantity of the waveform sample data collectively transferred from said storage device;

temporarily storing into a buffer the waveform sample data collectively transferred from said storage device and received by said step of receiving; and reading out the waveform sample data from said buffer in accordance with pitch information and generating tone waveform data corresponding to the pitch information on the basis of the waveform sample data read out from said buffer.

38. A machine-readable recording medium containing a group of instructions of a program to be executed by a processor to generate tone waveform data on the basis of waveform sample data stored in a storage device, said program comprising the steps of:

determining, in accordance with pitch information, a specific quantity of the waveform sample data to be received;

requesting said storage device to collectively transfer said specific quantity of the waveform sample data;

receiving a block containing said specific quantity of the waveform sample data collectively transferred from said storage device;

temporarily storing into a buffer the waveform sample data collectively transferred from said storage device and received by said step of receiving; and reading out the waveform sample data from said buffer in accordance with pitch information and generating tone waveform data corresponding to the pitch information on the basis of the waveform sample data read out from said buffer.

39. A method of generating tone waveform data on the basis of waveform sample data stored in a storage device connected to an extended bus of a computer by accessing the storage device via the extended bus, said method comprising the steps of:

designating a block containing a specific quantity of the waveform sampled data and requesting, separately for each of a plurality of channels, that the designated block of the waveform sample data to be used in the channel should be read out from said storage device and burst-transmitted via the extended bus;

temporarily storing into a buffer the waveform sample data burst-transmitted via the extended bus;

reading out for each of the channels the waveform sample data from said buffer in accordance with a rate corresponding to the pitch information within a short period of time asynchronously with a predetermined reproduction sampling cycle and generating tone waveform data corresponding to the pitch information on the basis of the waveform sampled data read out from said buffer, and further adding together the tone waveform data of the channels generated by said reading step; and temporarily storing into an output buffer the tone waveform data added during said reading step, each of the tone waveform data temporarily stored in said output buffer being sequentially read out in the predetermined reproduction sampling cycle.

40. A machine-readable recording medium containing a group of instructions of a program to be executed by a processor to generate tone waveform data on the basis of waveform sample data stored in a storage device connected to an extended bus of a computer by accessing the storage device via the extended bus; said program comprising the steps of:

designating a block containing a specific quantity of the waveform sampled data and requesting, separately for each of a plurality of channels, that the designated block of the waveform sample data to be used in the channel should be read out from said storage device and burst-transmitted via the extended bus;

temporarily storing into a buffer the waveform sample data burst-transmitted via the extended bus;

reading out for each of the channels the waveform sample data from said buffer in accordance with a rate corresponding to the pitch information within a short period of time asynchronously with a predetermined reproduction sampling cycle and generating tone waveform data corresponding to the pitch information on the basis of the waveform sampled data read out from said buffer, and further adding together the tone waveform data of the channels generated by said reading step; and temporarily storing into an output buffer the tone waveform data added during said reading step, each of the tone waveform data temporarily stored in said output buffer being sequentially read out in the predetermined reproduction sampling cycle.

41. A method of generating tone waveform data on the basis of waveform sample data stored in a storage device having stored therein predetermined original waveform sample data and thinned waveform sample data obtained by thinning the original waveform sample data, said method comprising the steps of:

in accordance with pitch information, selecting the original waveform sample data or the thinned waveform sample data and determining a specific quantity of the waveform sample data to be contained in a block of the waveform sample data;

receiving said block containing the specific quantity of the waveform sample data collectively transferred from said storage device;

temporarily storing into a buffer the waveform sample data collectively transferred from said storage device and received by said step of receiving; and reading out the waveform sample data from said buffer in accordance with the pitch information and generating tone waveform data corresponding to the pitch information on the basis of the waveform sample data read out from said buffer.

42. A machine-readable recording medium containing a group of instructions of a program to be executed by a processor to generate tone waveform data on the basis of waveform sample data stored in a storage device having stored therein predetermined original waveform sample data and thinned waveform sample data obtained by thinning the original waveform sample data, said program comprising the steps of:

in accordance with pitch information, selecting the original waveform sample data or the thinned waveform sample data and determining a specific quantity of the waveform sample data to be contained in a block of the waveform sample data;

receiving said block containing the specific quantity of the waveform sample data collectively transferred from said storage device;

temporarily storing into a buffer the waveform sample data collectively transferred from said storage device and received by said step of receiving; and reading out the waveform sample data from said buffer in accordance with the pitch information and generating tone waveform data corresponding to the pitch information on the basis of the waveform sample data read out from said buffer.

43. A method of generating tone waveform data on the basis of predetermined original waveform sample data stored in a storage device, said method comprising the steps of:

receiving a block containing a specific quantity of the original waveform sample data collectively transferred from said storage device;

in accordance with pitch information, thinning the original waveform sample data collectively transferred from said storage device to thereby generate thinned waveform sample data;

temporarily storing into a buffer the original waveform sample data or the thinned waveform sample data collectively transferred from said storage device and received by said step of receiving; and reading out the waveform sample data from said temporary storage section in accordance with the pitch information and generating tone waveform data corresponding to the pitch information on the basis of the waveform sample data read out from said buffer.

44. A machine-readable recording medium containing a group of instructions of a program to be executed by a processor to generate tone waveform data on the basis of predetermined original waveform sample data stored in a storage device, said program comprising the steps of:

receiving a block containing a specific quantity of the original waveform sample data collectively transferred from said storage device;

in accordance with pitch information, thinning the original waveform sample data collectively transferred from said storage device to thereby generate thinned waveform sample data;

temporarily storing into a buffer the original waveform sample data or the thinned waveform sample data collectively transferred from said storage device and received by said step of receiving; and reading out the waveform sample data from said temporary storage section in accordance with the pitch information and generating tone waveform data corresponding to the pitch information on the basis of the waveform sample data read out from said buffer.

45. A method of generating tone waveform data on the basis of waveform sample data stored in a storage device, said storage device having stored therein predetermined original waveform sample data and thinned waveform sample data stored obtained by thinning the original waveform sample data in accordance with a predetermined thinning scheme, said method comprising:

a first step of, on the basis of pitch information indicative of a particular reproducing pitch, reading out the original waveform sample data or the thinned waveform sample data from said storage device;

a second step of storing into a buffer the waveform sample data read out from said storage device by said first step a third step of, on the basis of the pitch information, reading out the waveform sample data from said buffer; and a fourth step of generating tone waveform data on the basis of the waveform sample data read out from said buffer by said third step.

46. A machine-readable recording medium containing a group of instructions of a program to be executed by a processor to generate tone waveform data on the basis of waveform sample data stored in a storage device, said storage device having stored therein predetermined original waveform sample data and thinned waveform sample data stored obtained by thinning the original waveform sample data in accordance with a predetermined thinning scheme, said program comprising:

a first step of, on the basis of pitch information indicative of a particular reproducing pitch, reading out the original waveform sample data or the thinned waveform sample data from said storage device;

a second step of storing into a buffer the waveform sample data read out from said storage device by said first step a third step of, on the basis of the pitch information, reading out the waveform sample data from said buffer; and a fourth step of generating tone waveform data on the basis of the waveform sample data read out from said buffer by said third step.

47. A method of generating tone waveform data on the basis of waveform sample data stored in a storage device, said method comprising:

a first step of reading out the waveform sample data from said external storage device;

a second step of, on the basis of pitch information indicative of a particular reproducing pitch, thinning the waveform sample data read out from said external storage device by said first step, to thereby generate thinned waveform sample data;

a third step of storing into a buffer the thinned waveform sample data generated by said second step;

a fourth step of, on the basis of the pitch information, reading out the waveform sample data from said buffer; and a fifth step of generating tone waveform data on the basis of the waveform sample data read out from said buffer by said fourth step.

48. A machine-readable recording medium containing a group of instructions of a program to be executed by a processor to generate tone waveform data on the basis of waveform sample data stored in a storage device, said program comprising:

a first step of reading out the waveform sample data from said external storage device;

a second step of, on the basis of pitch information indicative of a particular reproducing pitch, thinning the waveform sample data read out from said external storage device by said first step, to thereby generate thinned waveform sample data;

a third step of storing into a buffer the thinned waveform sample data generated by said second step;

a fourth step of, on the basis of the pitch information, reading out the waveform sample data from said buffer; and a fifth step of generating tone waveform data on the basis of the waveform sample data read out from said buffer by said fourth step.

* * * * *